US005815957A

United States Patent [19]

McKeown

[11] Patent Number: 5,815,957

[45] Date of Patent: Oct. 6, 1998

[54] SNOWPLOW SNOW CHANNELER

[76] Inventor: Ronald Wayne McKeown, 4989 W. Clayton Rd., Madison, Wis. 53711

[21] Appl. No.: 806,039

[22] Filed: Feb. 8, 1997

[51] Int. Cl.[6] ..... E01H 5/06

[52] U.S. Cl. ..... 37/280; 37/216; 172/815

[58] Field of Search ..... 37/214, 215, 216, 37/231, 266, 274, 275, 276, 279, 280, 281, DIG. 4, DIG. 5; 172/701, 782, 784, 815

[56] References Cited

U.S. PATENT DOCUMENTS 3,803,733 4/1974 Ramsey ..... 172/815 X
4,667,426 5/1987 Howard et al. ..... 37/281 X
4,723,609 2/1988 Curtis ..... 172/815
4,741,116 5/1988 Engle et al. ..... 37/280
4,779,363 10/1988 Boutrais et al. ..... 172/815 X
4,962,600 10/1990 Zellaha et al. ..... 37/280

*Primary Examiner*—Terry Lee Melius
*Assistant Examiner*—Robert Pezzuto
*Attorney, Agent, or Firm*—Loyd W. Bonneville

[57] ABSTRACT

Device relating to a paired set of snow spoons mounted at or near the ends of a snowplow blade, featuring alternative two-position emplacements and an optional street-side obstruction buffer.

15 Claims, 13 Drawing Sheets

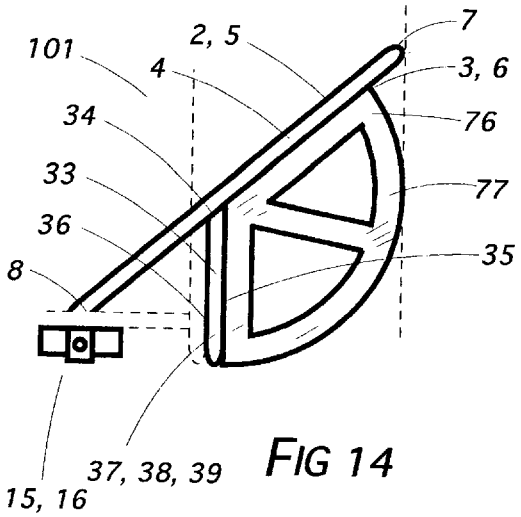
FIG 14
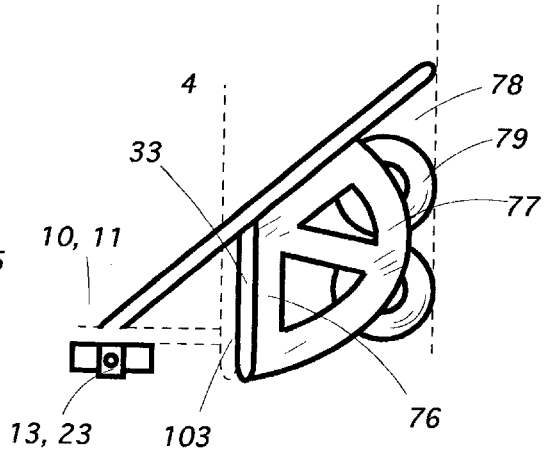
FIG 15
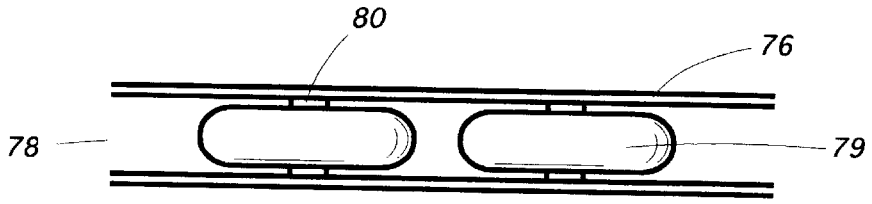
FIG 16
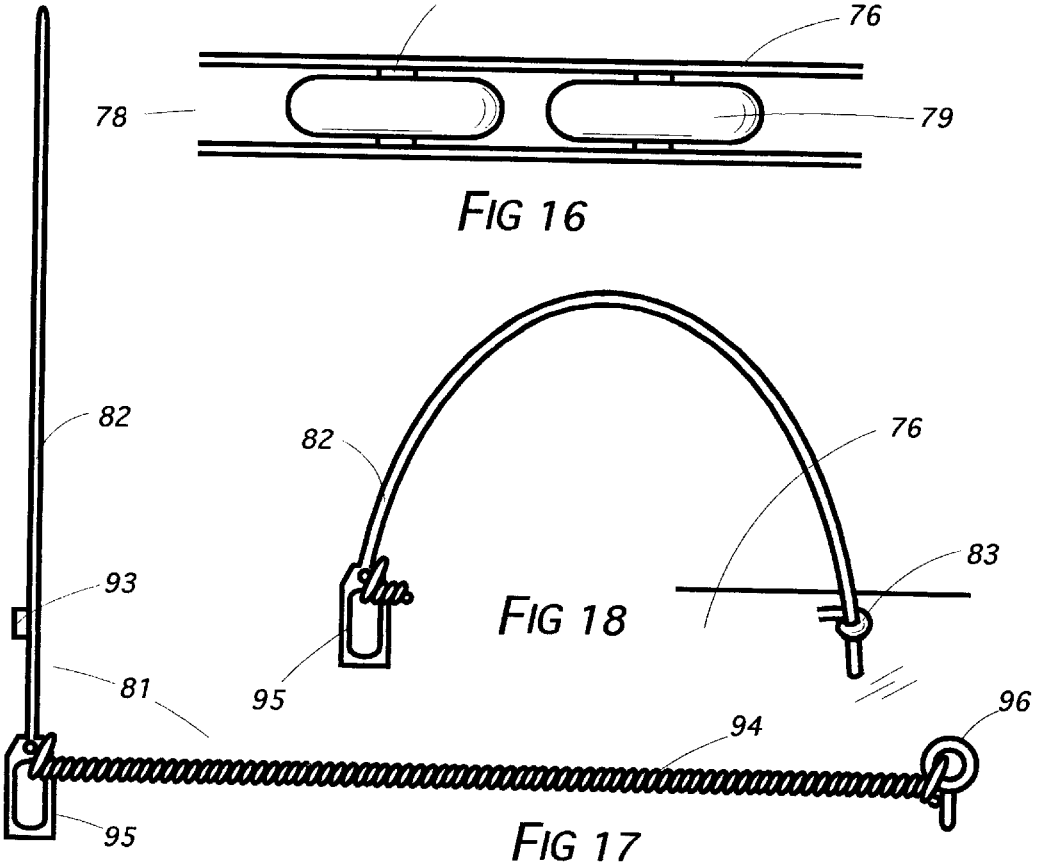
FIG 18
FIG 17

SNOWPLOW SNOW CHANNELER

BACKGROUND OF THE INVENTION

1. Field of the Invention

Snowplow accessories

2. Description of the Prior Art

Snowplowing requires considerable efficiency in its undertaking. It is a common experience to displace snow from the immediate path of the plow only to leave deep snow mounds along each side which require one or more plowing sweeps to clean up. Prior art discloses several attempts to address this problem. Historically, efforts characteristically have involved the addition of structures on each end of the snowplow blade (100) to effectually increase the width of the plowing system. More recent examples include U.S. Pat. No. 4,741,116, issued to Engle et al. and U.S. Pat. No. 4,962,600, issued to Zellaha. The first of those two criticizes four previous patents because of the complexity of the devices, typically requiring hydraulic power for their operation. Engle, therefore, employs what he refers to as "wing extension units" which are fixed in place during operation with the "blade elements" on each end presenting a predetermined forward angle with respect to the right-to-left orientation of the snowplow blade (100). His device employs for each plate an elbowed "stabilizing arm". That elbowed structure attaches the inboard portion of his wing extension unit to the outer extremity of the snowplow blade (100) so that there is but one coupling site available for emplacement for each plate. Emplacement and removal require bolting and unbolting, respectively. Zellaha employs what he describes as a "wing plate" which also is fixed in place during employment but employs means to pivot the structure around the snowplow blade's end ridge (103). The pivoting action presumably facilitates emplacement of the structure by allowing its weight to rest upon the pivoting system so the inboard portion may be swung into place. Zellaha insists that the part of the device which is emplaced on the hinge be mounted "centrally" on the "wing plate". Once emplaced and during snowplowing operation, the angular aspect of the plate with reference to the snowplow blade (100) is fixed. Both the Zellaha and Engle devices are suitable for highway snowplowing and for reasons discussed herein ante, do not address certain urban snowplowing tasks. While, as mentioned supra, some of the devices of the prior art involved hydraulic control of the blades so that their angular relationship to the snowplow blade could be manipulated during snowplowing operation, such control over the blades in any way, hydraulic or otherwise, is not contemplated for either of Engle or Zellaha devices.

The type of snowplow systems contemplated by the invention (1) and the prior art under discussion do not usually include the prow type of blade which is pointed forward at its center with the sides swept back. On the prow type blade, each side lies generally in separate vertical planes, if the blade's curvature may be ignored for purposes of discussion. Nonetheless, the invention may be employed on the prow type blade as well as any others and when so employed, provides a means of spooning at least some of the snow which would otherwise be discharged outwards at the extremities of the blades. For most applications, however, the systems contemplated here rather address those which in that same general way occupy a single vertical plane. The structural orientation of the snowplow blade (100) is more specifically dealt with ante.

Because in any end plate system, snow will eventually accumulate and spill off at the edge trailing snow mounds along the cleared path, there is a need for a system in which the angular relationship of the end plates may be adjusted to accommodate varied conditions such as the depth of the snow or its moisture content.

Devices are employed in the prior art employing a flexible end plate underbuffer sometimes referred to as a shoe (104). Those devices are designed to protect the end plates from damage and absorb the shock presented by unevenness in the underlying surface being plowed. Because emplacement of the devices in the prior art is as far outboard as they are, the benefit from the underbuffer is considerably limited. Existing prior art devices require the placement of snow spoons (4) at an open angle, oriented outwards toward the sides, so that the shoe (104) is vulnerable to considerable wear and tear it would not incur if pointed in a more forward angle. There is a need for a configuration in which the underbuffers may be employed in a more forward angle and farther inboard than they have been. The needs associated with employment of the shoe (104) might be better met by permitting adjustment of the end plates to such positions.

Certain specific needs which are not relevant to nonurban highway snowplowing must be addressed in employing nonhydraulically controlled systems in urban settings—those involving parking lots driveways and the more congested city streets. The mere cutting of a snow trench or the lateral displacement of snow as is done on highways does not fulfill these urban needs. In an urban setting, the snow must often be piled in a particular place or totally removed from the lot and not merely be displaced from the immediate pathway. Thus, for such urbanized use, it would be helpful if the snow could be effectually spooned not only forward but part ally upward as well. A considerable degree of control might then be employed in the snow's placement.

However, if a more efficient snow spooning system were employed, there would be the further need for capability in certain applications to adjust the system to reduce frontal profile—that is, system width—so that cleaning in relatively narrow places is possible. Sometimes, snow must be cleaned from parking places located between cars parked on a lot. One way of meeting this need would be to configure the system so that one might change the emplacement of the end plates with reference to the snowplow blade (100) to reduce their lateral projection.

Fulfilling the need to control placement of the plowed snow by installing the invention's snow spoons embraces a further need. Their installation introduces a factor not otherwise involved in snowplow operation. As will be seen ante the shanks (30) of the pins (18) employed in securing them in place are sometimes provided with a shearing loci—that is a point of selected weakness. At least one of the prior art devices cited supra also is so constructed. That feature, when present, goes far to prevent damage which might otherwise result when a snowplow blade (100) strikes a solid object along the roadway during snowplowing forward operation. However, there remains a need to avoid damage upon backing the snowplow against such an object. The prior art attachment schemes do not accommodate that risk and are, therefore, vulnerable to considerable damage to the plow blade (100), at least at the inboard site, as well as to damage to the device itself. The configuration of prior art attachment at the inboard site does not provide an inboard pivot point for the device but, to the contrary, effectually locks it more or less rigidly in place. Moreover, without particular attention being paid to the precise manner in which prior art outboard placement is made, one cannot be sure, even if shear pins are employed at the outboard site, that every part of the device would clear the end of the snowplow blade (100) when the device is forced inward by impact during a backing operation.

Another urban need which highway snowplowing does not address is to permit cleaning close to curbs without inordinate risk of damage to the snowplow, the plate devices or the curb itself. Curbs or outlying obstructions are often hidden from the operator's view. This need is apparent whether in highway snowplowing or the more urbanized applications, the highway obstructions including mailboxes, stone edgework and snow covered trash. There is a further need to assist motorists in parking their vehicles and aligning them during travel with reference to the entire roadway width. It would be helpful in meeting these needs to have the system configured with a buffer of some type along its outboard side.

There is the further need in highway snowplowing of reducing frontal profile in a more drastic way from that mentioned supra, when the system is not actually employed in snowplowing operation. For example, after snowplowing is completed at a given site, the system is driven on the highway back to the place from whence it was brought. Although it is unlawful in many states to operate a vehicle on a highway with an object on its inboard side projecting beyond a certain distance across the road, some snowplows have been observed in highway travel with the inboard end plate still extended in place. The operator may not always have tools to disconnect it at the site or may simply wish to postpone taking the trouble to do so, particularly if the distance of highway travel is short. Whatever the reason, travelling with such a lateral projection endangers both the snowplow operator and other motorists on the highway. This need to reduce frontal profile might be met by employing an end plate system, sufficiently light in weight for the purpose, in which one or both plates might easily be removed and stowed in some other place such as at the snowplow blade's posterior (102). This stowage need might also be met by configuring the plates so that either they might in their entirety be pivoted inboard or such that some portion of them might be folded inward.

A more subordinated need to that of the others concerns a way to avoid damage to a whip sight (81) commonly relied upon to align the system in operation by stowing it when not in use. Usually the end of a snowplow blade (100) and any devices employed in conjunction with it are obscured from the snowplow operator's view. A whip site mast (82), readily visible from the operator's cab, permits him or her to aim the snowplow along the roadway and to deduce the location of those parts of the snowplowing system. Because the mast (82), when not in use, sticks up unsupported except at its base, making it susceptible to damage, there is a need for a stowage configuration to obviate that risk.

SUMMARY OF THE INVENTION

The present invention (1) is a paired set of snow spoons (4) and means for emplacing them at or near the ends of a snowplow blade (100). Their employment permits a snowplow operator to control placement of the cleared snow, localizing it into piles, a feature which addresses the need discussed supra concerning the clearing of parking lots, driveways, curbside areas and other urban application sites. Selection of one of first and second alternative outboard emplacing positions it (1) features positions the snow spoons (4) slightly more inboard and in a more forward aspect so that frontal profile is reduced. This more forward position of adjustment also limits the amount of snow which may escape along at the edge of the snowplowing system.

A stabilizing plate (33) provides structural support for the device's emplacement and may be employed in conjunction with means of outboard snow spoon coupling (53) with the snowplow blade (100).

The device (1) may optionally feature an obstruction buffer (76) situated outboard and alongside, particularly useful in meeting the need referred to supra concerning curbside snowplowing. The buffer (76) may feature simple fending plates (77) or a more complex wheel assembly (78). Wheels (79) may be of polygonal rather than round configuration to fulfill particular demands.

A brace (73) providing additional integral support between the two primary structural parts of the device, the snow spoon (4) and the stabilizing plate (33), may also be optionally attached in manufacture. However, installation of one or more gussets (42) between those parts (4, 33) may suffice for that purpose in most applications.

One embodiment of the invention (1) permits an inward folding together of first (86) and second (87) fold-against sections of the snow spoons (4) upon a hinge (88) or pivot. That feature is one of those which might be employed in addressing the need discussed supra concerning enhancement of highway safety by reducing frontal profile when travelling on the highway with the system not in snowplowing use.

Applicant's invention (1) features both inboard and outboard coupling sites (10, 50). Inboard coupling employs either of two fixed primary pinning configurations. Pinning of the snow spoons (4) to the snowplow blade (100) at their inboard sites (10) may be either at a posterior coupling site (11) or a face coupling site (12) of the blade (100). The coupling configuration must be determined either in manufacture or when retrofitting an existing snowplow blade (100). Once one of the two configurations is so determined, the other one may not be employed without alteration. The pins (18) employed at the inboard coupling sites (11, 12) shear upon subjection to a certain level of impact to avoid damage to the snowplow blade (100), damage to the roadway itself or objects situated upon or in proximity to it as well as damage to the device itself (1).

While outboard coupling may be direct, employing one or more shear pins (18) at that site (50), one may with such coupling be unable to retrieve the device (1) should it become dislodged. Further, only one mode of outboard positioning is available when direct pinning is employed there.

Preferably, outboard coupling permits either first and second alternative adjustment positions which may be operationally elected and changed at the work site to suit the operator's needs. The snow spoons (4) may, thus, be positioned at either a narrower or wider angle with reference to forward direction. The narrower angle mode enhances spooning capability and, by repositioning the snow spoon (4) slightly inboard, reduces frontal profile of the system from that of the wider angle mode. The outboard coupling assembly (53) of those alternative modes includes a coupling binding material (60), preferably a chain, and what is well known in the prior art as a "load binder" (66) or as occasionally referred to herein, a "contraction binder". The first and second alternative mode arrangement permits the device's (1) retention by the binding material (60) in the event of dislodgment, despite a shearing of the coupling pin (18) at the inboard site (11, 12).

The device (1) may also feature a flexible whip sight assembly (81) for use as a directional aiming guide and as an indicator of the location of snowplowing system parts obscured from view beneath it. A means for its stowage (84) when not in use is also included.

BRIEF DESCRIPTION OF THE DRAWINGS

FIG. 1—perspective view of the snow spoon (4) and stabilizing plate (33) employing the brace (73);

FIG. 2—front view of invention (1) emplaced upon a snowplow blade (100);

FIG. 3—cross section of device (1) oriented along line 3—3 of FIG. 2;

FIG. 4—cross section oriented along line 3—3 of FIG. 2 showing snow spoon (4) of an embodiment with a centrally connected stabilizing plate (33);

FIG. 5—rear view of the device (1) employing outboard pin coupling assembly (54);

FIG. 14—top view of obstruction buffer (76) employing fending plate (77);

FIG. 15—top view of obstruction buffer (76) employing wheel assembly (78);

FIG. 16—side view of wheel assembly (78);

FIG. 17—side view of whip sight assembly (81);

FIG. 18—side view of whip sight mast (82) stowed in stowage receptor (83);

DESCRIPTION OF THE PREFERRED EMBODIMENT

Figure 1:
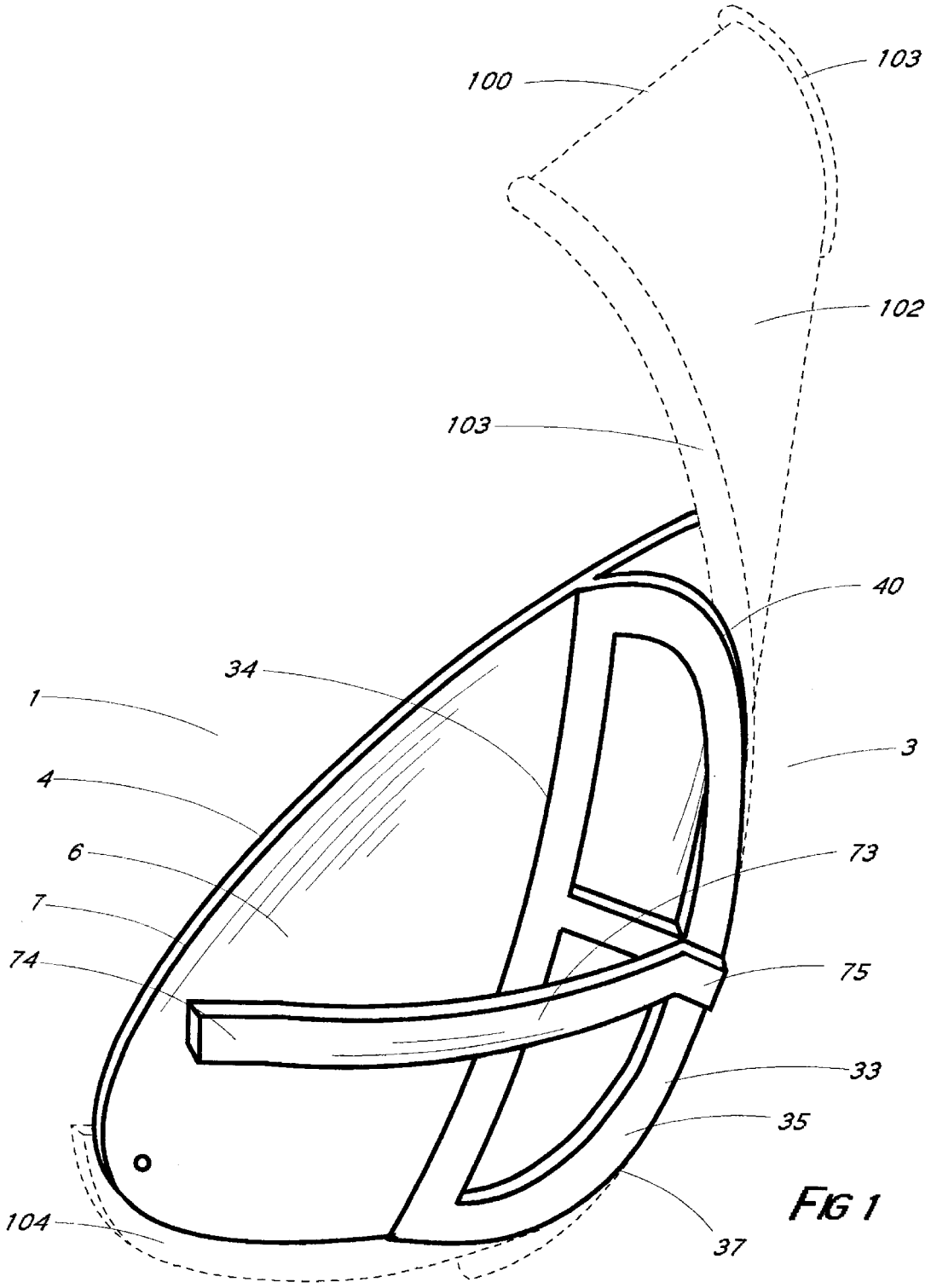
FIGS. 1–5 represent various views of a typical embodiment of the device (1). They are, respectively.
Figure 2:
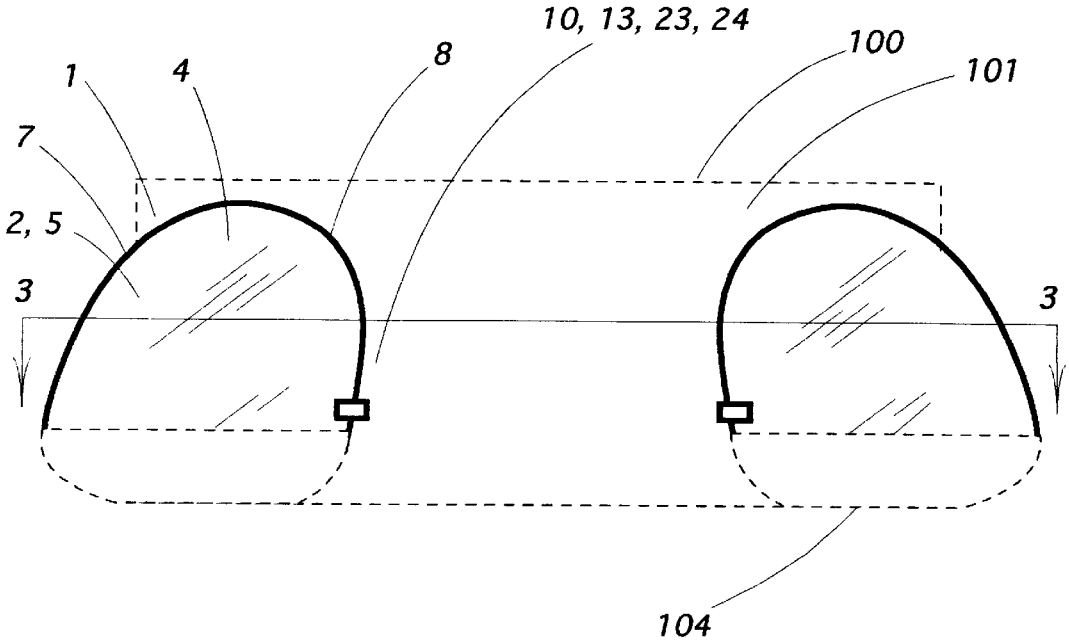
Figure 3:
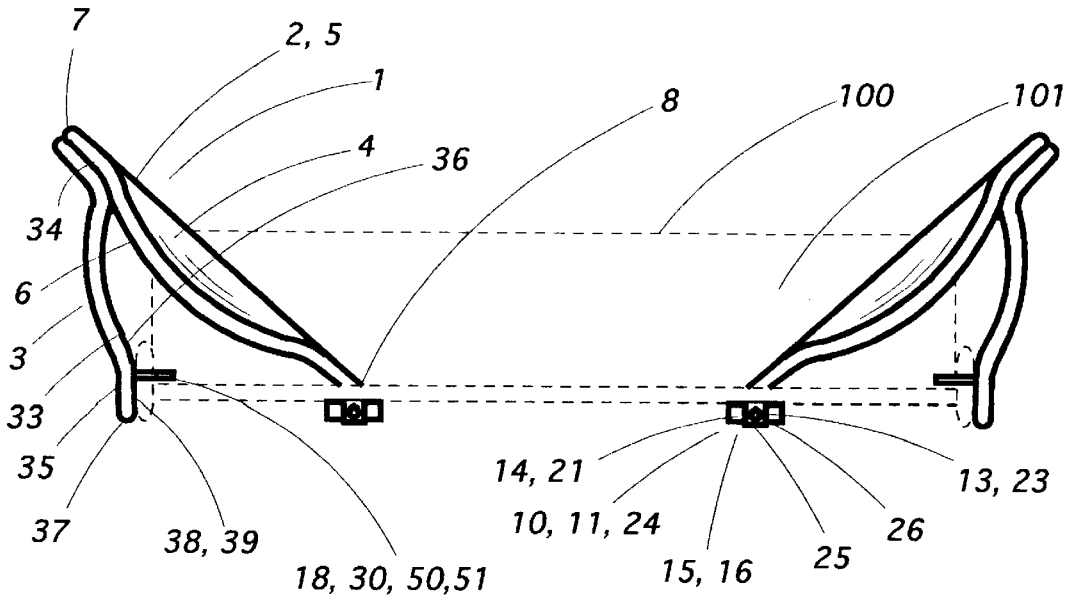
Figure 4:
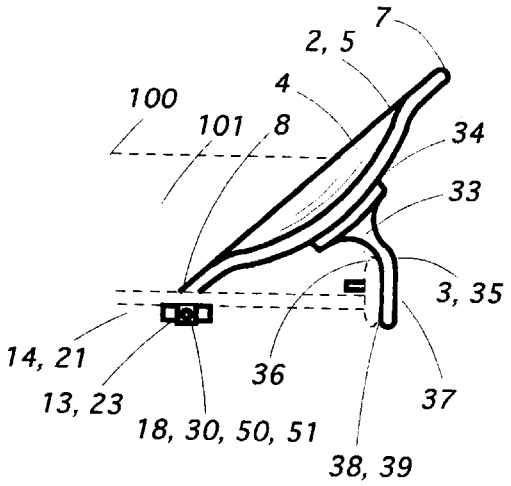
Figure 5:
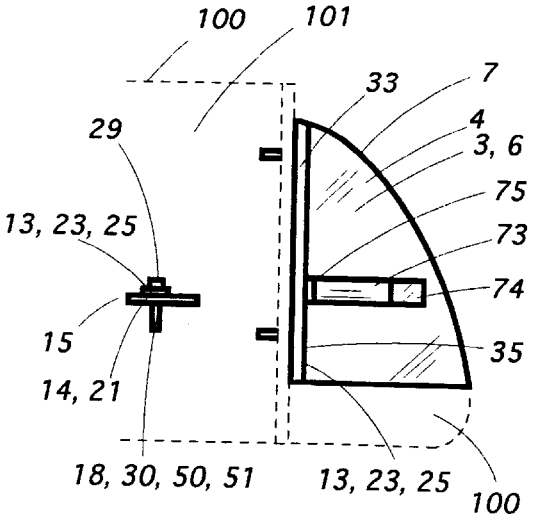
Figure 6:
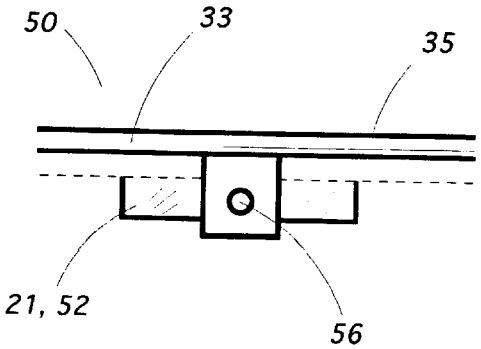
FIG. 6—top view of apertured coupling pin receptor plate (21) employed at outboard coupling site (50)
Figure 7:
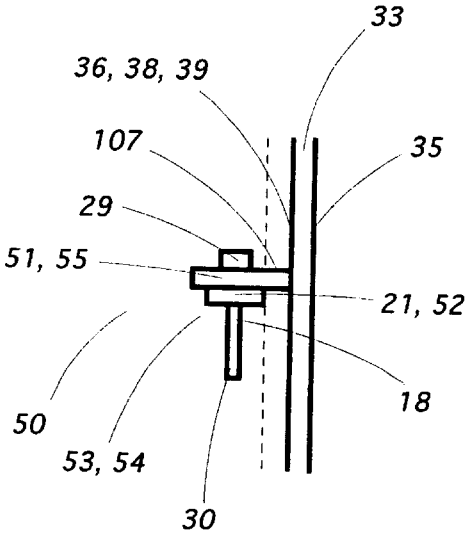
FIG. 7—side view of outboard pin coupling assembly (54)
Figure 8:
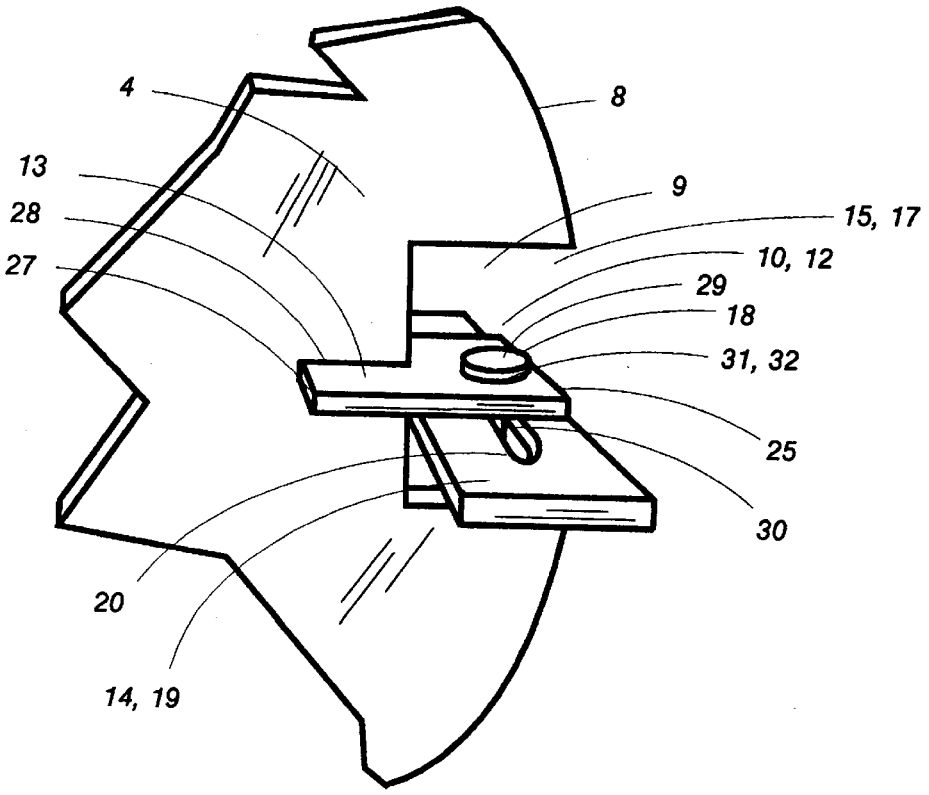
FIG. 8—perspective view of inboard coupling site upon snowplow blade face (12) showing attachment site for apertured snow spoon coupling tongue (23) within an attachment recess (28) along a portion of the snow spoon's arcuate plate seating edge (8)
Figure 9:
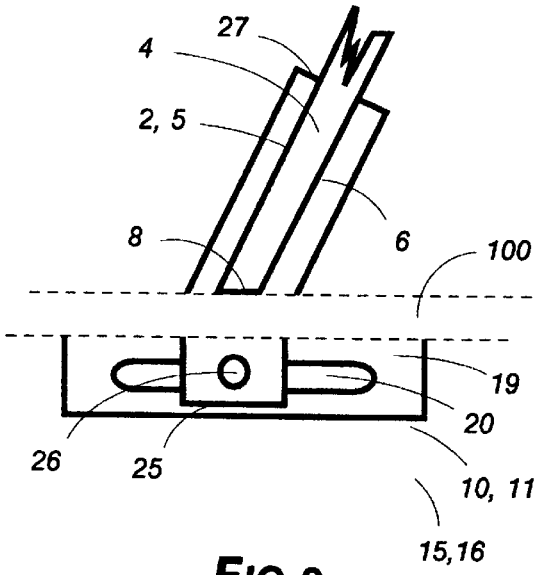
FIG. 9—top view of snowplow blade posterior inboard coupling site (11) employing slotted receptor plate (19) as snowplow blade-attached inboard coupler receiving means (14)
Figure 10:
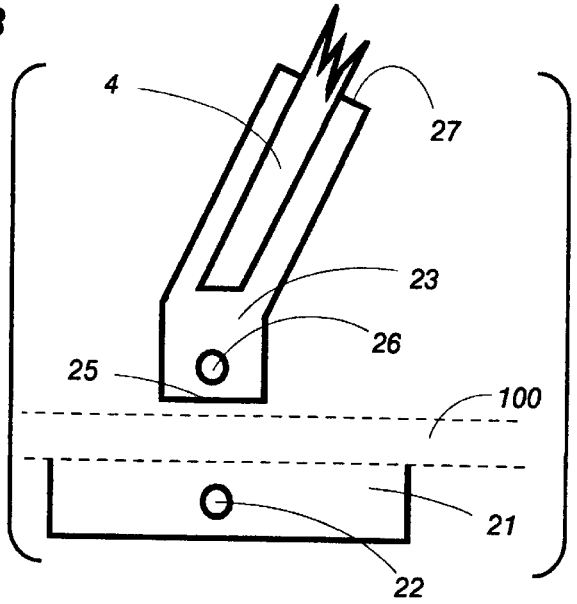
FIG. 10—top view of snowplow blade posterior inboard coupling site employing apertured receptor plate (21) as snowplow blade-attached inboard coupler receiving means (14)
Figure 11:
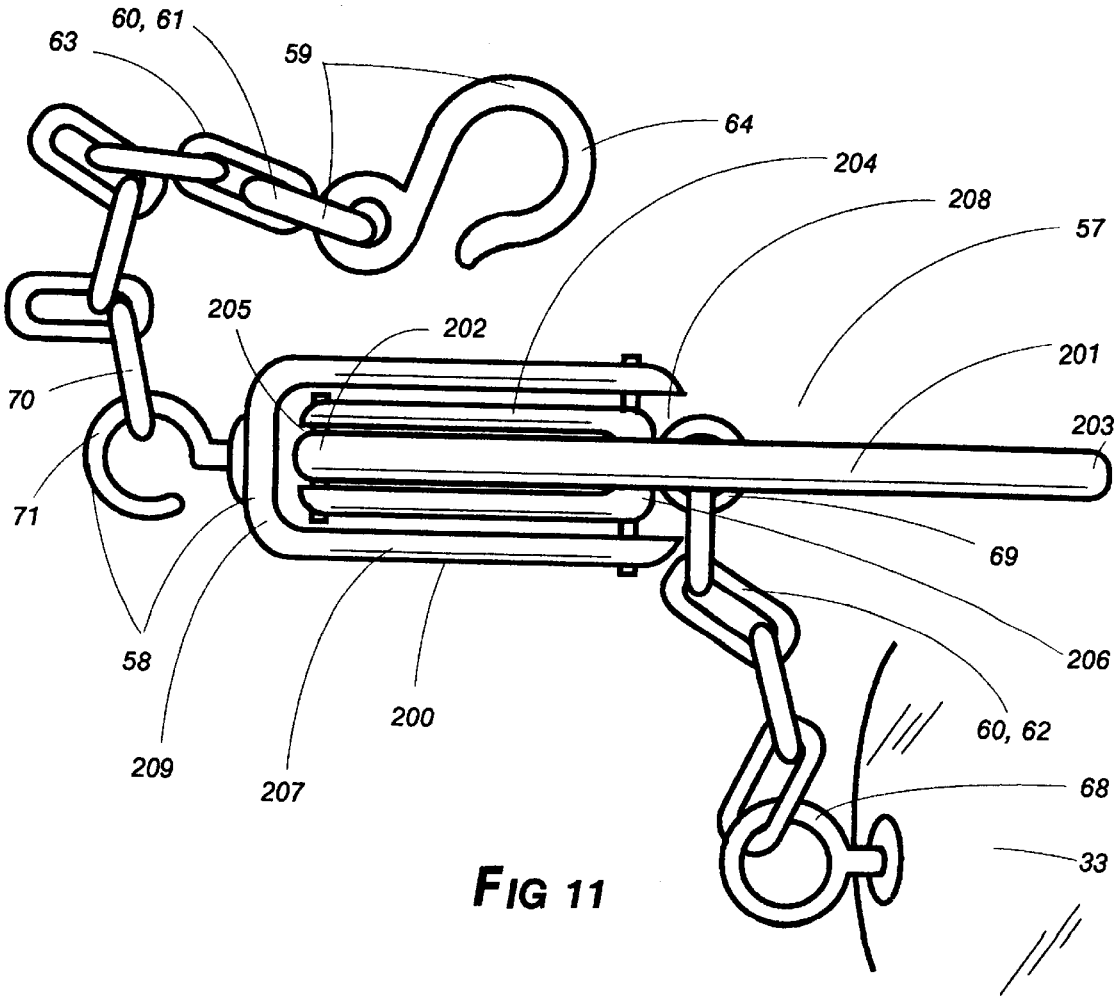
FIG. 11—perspective view of outboard two-position coupling assembly (57) showing emplacing assembly (59) and receiving assembly (59), coupling chain as binding material (60) and contraction binder (200)
Figure 12:
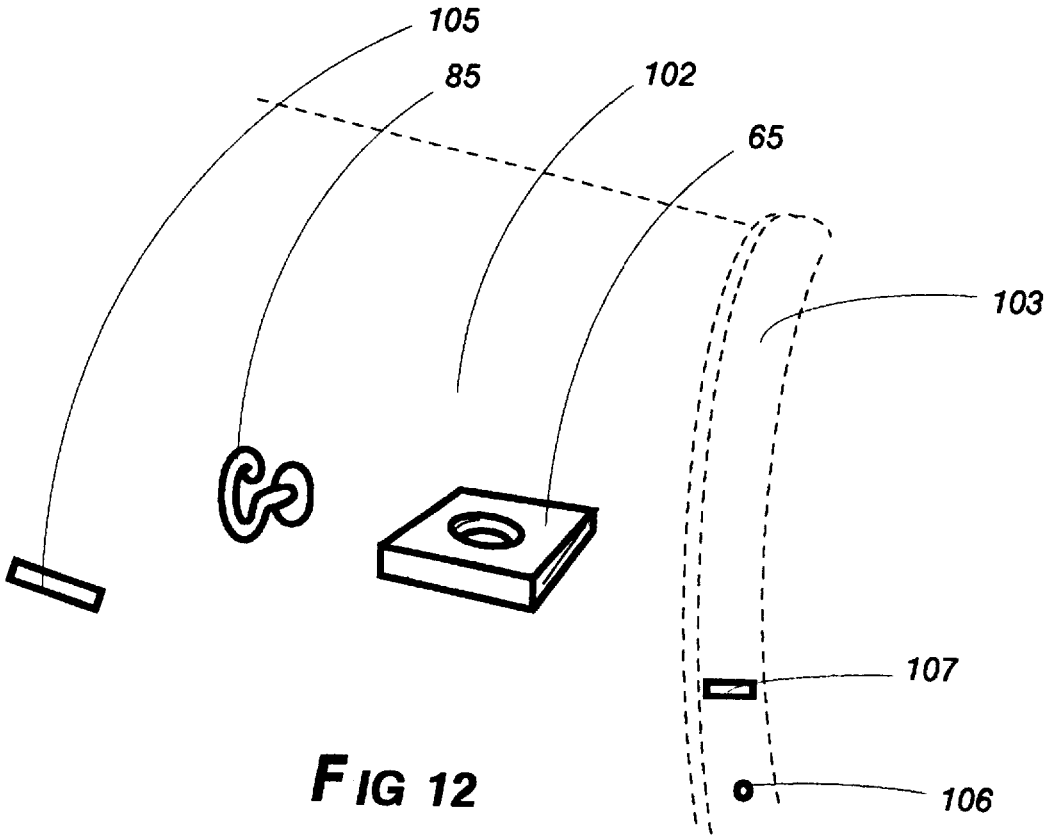
FIG. 12—perspective view of snowplow blade posterior (102) showing receptacle means (85) for stowage of device (1) when not in operation, snowplow end ridge abutment aperture (106) for stabilizing plate positioning nipple (41), two-position coupling assembly's apertured receptor (65) for receptor insertion hook (64) and inboard and outboard coupling tongue slots (105, 107, respectively)
Figure 13:
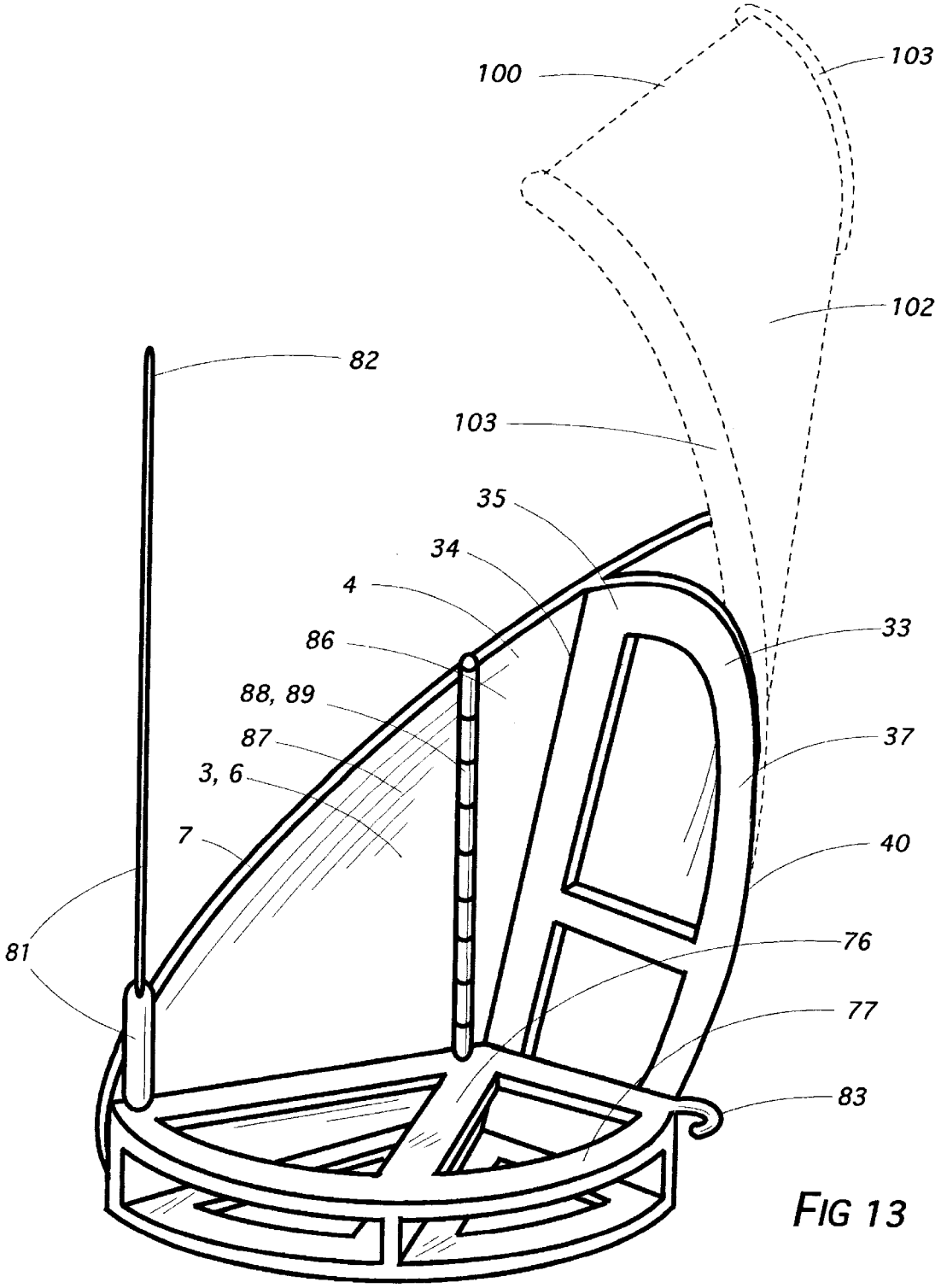
FIG. 13—perspective view of embodiment of snow spoon employing obstruction buffer (76), whip sight assembly (81) and spoon folding elements (86–89)
Figure 19:
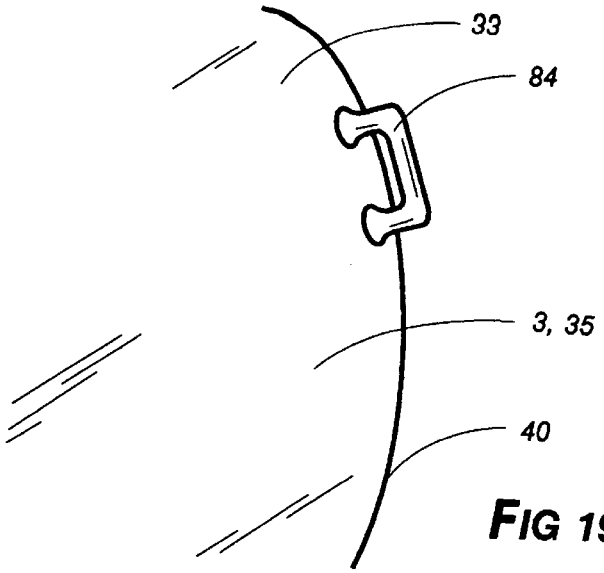
FIG. 19—perspective view of stabilizing plate's outboard face (35) showing device stowing emplacement means (84) which may also be employed as a carrying handle.
Figure 20:
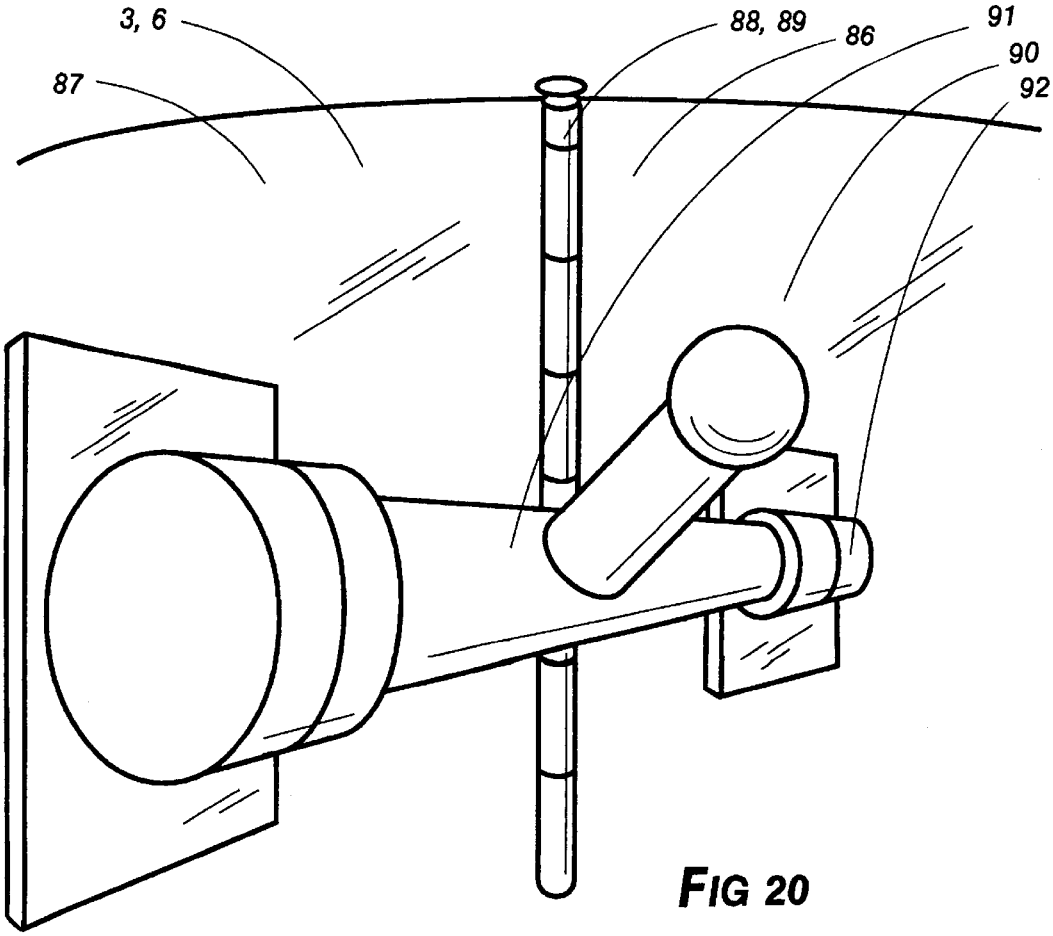
FIG. 20—perspective view of latching means (90) for snow spoon's folded sections (86, 87)
Figure 21:
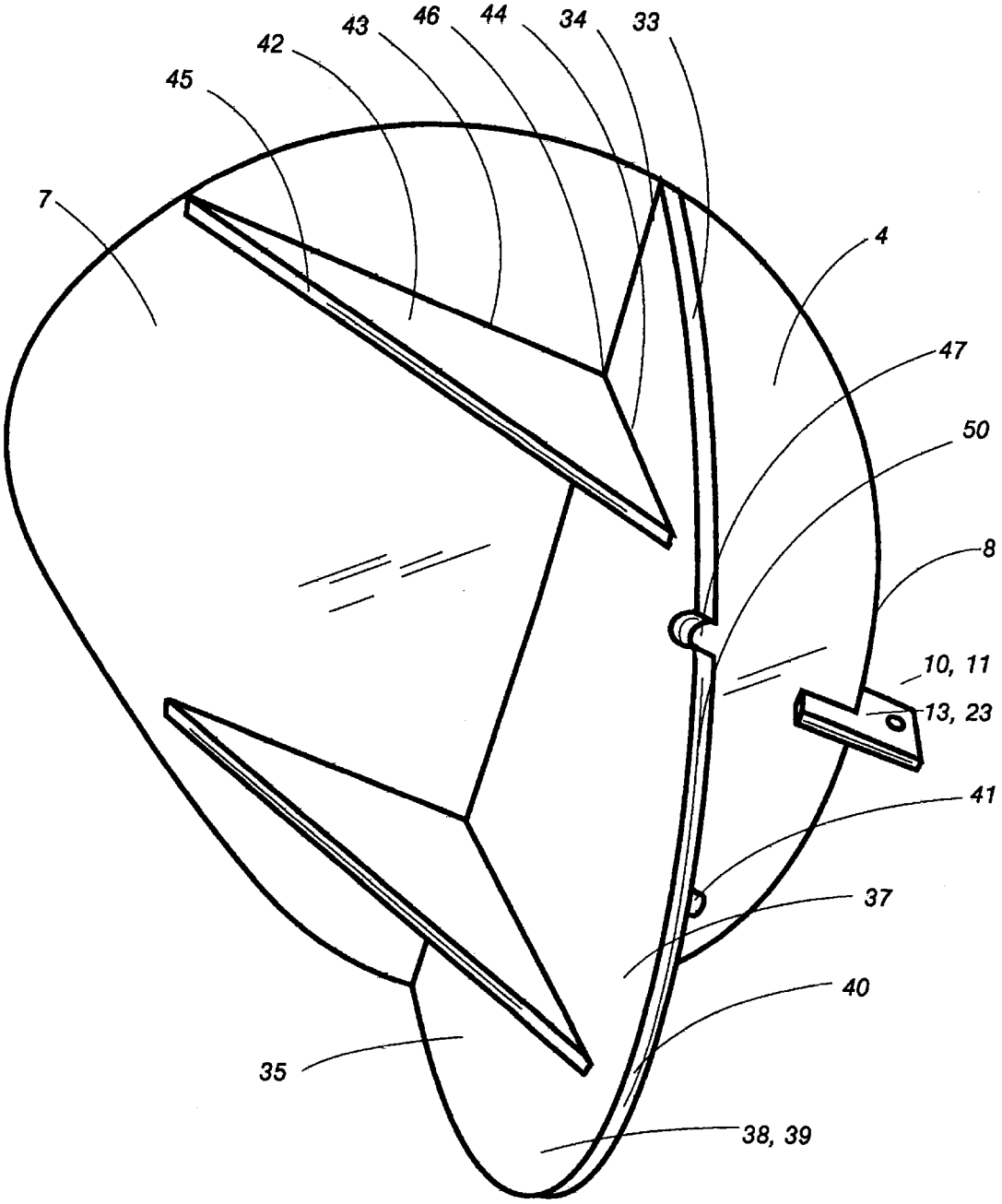
FIG. 21—perspective view of gussets (42) including stabilizing plate notch (47) to accommodate the binding material (60) in two-position coupling.

A snowplow snow channeler (1) is employed on conjunction with a snowplow blade (100). The snow channeler (1) comprises a pair of snow spoons (4) situated generally at opposite ends of the blade (100). The specific emplacement of the snow spoons (4) is further discussed ante. The two snow spoons (4) are enantiomers of one another—that is, their relationship bears to one another that of mirror images.

The snow spoons (4) may be made in any one of several specific shapes. They may be made flat, convex, concave or even somewhat irregular in surface aspect. Experience indicates that a dished or concave form performs more efficiently than others in spooning snow lying on the ground—that is, in moving it with a cupping action forward and slightly upward while directing its placement, much as one might demonstrate with hands cupped and held together at the wrists. Despite the desirability of a snow spoon (4) concavely shaped, however, it is cheaper to manufacture a perfectly flat one (4). Experience also indicates that a convexly shaped snow spoon (4) tends to displace its contents in a peripheral direction more than does one (4) of another shape.

All of those shapes share a common property in comprising length and breadth greater than thickness—that is, exhibiting a considerably broader or plate-like aspect in two dimensions and a generally thinner one in the third dimension. All of them may, thus, be considered in a very general way to occupy a plane of more or less thickness. A perfectly flattened one, of course, describes a plane. The same is true of a snowplow blade (100). While it (100) has a curved aspect from top to bottom, it may be considered in a very general way when in use to occupy a generally upright plane of some thickness. When a snow spoon (4) is emplaced upon the snowplow blade (100) for use, the general plane it describes or occupies is also upright. Viewing a snowplow blade—snow spoon (100-4) combination from above, their general planes as described herein are disposed at an angle with reference to one another. Looking forward from a snowplow cab, the upright plane of the snow spoon (4) emplaced at or toward the right end of the snowplow blade (100) is angled counterclockwise with reference to the upright plane of the snowplow blade (100). The snow spoon (4) emplaced at or toward the left end is angled clockwise with reference to it.

The snow channeler (1) is comprised of both an inboard side (2) and an outboard side (3). Similarly, the snow spoons (4) are stated in the claims to have an inboard snow spooning face (5) and an outboard face (6). The term inboard is meant to denote a point nearer the center of the snowplow blade (100) and away from the ends thereof. Thus, the orientation of the snow spoons (4) with reference to the snowplow blade (100) is less than a right angle so that when viewed from above, the angular relationship of the snowplow (100) and snow spoons (4) describes a truncated V. Seen thus, the inboard and outboard aspects of each snow spoon (4) and the fact that the inboard face (5) of each is also that which spoons the snow may be readily understood.

Each snow spoon (4) is stated in the claims to have a leading edge (7). That term has reference to the most forward portion of the snow spoon (4) in the direction of the snowplow's forward travel. The terminology concerning the arcuate snowplow blade seating edge (8) is employed in recognition of the fact that when the snow spoon (4) is situate in the angular relationship with the snowplow blade (100) discussed supra, the edge thereof (7) nearest to the snowplow is made to contact the most forward surface of the snowplow blade (100)—that is, its face (101). Preferably, the arc of the snow spoon (4) matches the curvature of the snowplow blade's face (101) in order to establish a snug fit.

Experience has demonstrated, however, that a perfectly snug fit, while desirable, is not essential to the device's (1) satisfactory operation. This is because snow has a tendency to pack, back up and stuff crevices when subjected to steady impaction such as that characteristic of the movement of a snowplow blade (100) in operation. This is a fortunate happenstance for applicant's invention (1), which features adjustment from one position to another. Such adjustment, of course, seats the snow spoon's arcuate posterior edge (8) upon part of the snowplow blade (100) which may comprise a different curvature. However, in view of the snow's impaction property, once an approximate fit for either of the outboard positioning alternatives has been established in manufacture, readjustment of the snow spoons (4) from one outboard position to the other may be made without preoccupying concern for snugness.

Preferably, the snow spoon (4) comprises a more or less elipsoid configuration, yet slightly triangular being narrower at the top than at the bottom. It is also preferable that it be rounded at points which otherwise might form corners. At points intended to be disposed proximate the snowplow blade (100), notches may be cut to make room for the heads of connecting bolts.

The claims state that the device comprises inboard coupler emplacing means connected to the snow spoon (13).

The term inboard in relation to coupling refers to the fact that there are both inboard (10) and outboard (50) coupling sites. Use of the term coupler and those similarly rooted, like coupling, mean that the snow spoon (4) is not actually attached or affixed to the snowplow blade (100) in a permanent way but instead merely emplaced thereon and removed therefrom. Emplacement must, of course, be sufficiently secure to avoid unintended dislodgment of the device (1). However, it (1) is designed for easy emplacement upon and removal from the snowplow blade (100). Preferably, it (1) should be light enough in weight to facilitate achieving that objective, yet durable enough to accomplish its intended purpose. In any event, it (1) is not intended to be bolted or otherwise fastened in place so as to make its connection permanent. Snowplow operators have made it a practice to employ a flexible end plate underbuffer (104) such as that discussed supra—sometimes referred to as a guide or a shoe. Although no claim is made for that device's inclusion herein, the use of such an object in conjunction with applicant's device (1) is not only preferable to achieve additional tolerance such as that mentioned supra, but strongly encouraged.

Preferably, to accomplish the objectives of the inboard emplacing (13) and receiving means (14), which together comprise an inboard coupling assembly (15), the snow spoon (4) may have affixed to it an apertured snow spoon coupling tongue (23). The aperture therein (26) must permit engagement with a coupling pin (18), discussed ante. For reasons relating to the two-position snow spoon adjustment feature which become more apparent ante, the coupling tongue (23) should be horizontally disposed upon coupling the snow spoon (4) to the snowplow blade (100).

In first and second embodiments of the invention (1) employing a snow spoon attaching tongue (23), a selected point on the snow spoon's arcuate blade seating edge (8) is the attachment site (24) of the tongue attaching end (27). By reference to that term is meant the end of the tongue (23) which is fastened in permanent fashion to the snow spoon (4), as distinguished from the tongue's blade coupling end (25). In those first and second embodiments employing the snow spoon attaching tongue (23), first and second configurations of snowplow blade receiving means (14), discussed ante, are necessary. In third and fourth embodiments of the invention (1) employing the snow spoon's attaching tongue (23), a point within an attachment recess (28) along a portion of the snow spoon's arcuate blade seating edge (8) is the attachment site (24) of the tongue attaching end (27). In those third and fourth embodiments employing the snow spoon's attaching tongue (23), third and fourth configurations of snowplow blade receiving means (14), also discussed ante, are necessary. Thus, it should be readily seen that the difference between the first two embodiments employing the spoon's attaching tongue (23) and the last two embodiments employing it (23) comprise the way in which the tongue (23) attaches to the snow spoon (4)—i.e., either at a point on the spoon's arcuate seating edge (8) or within a recess (28) cut into that edge (8).

The claims also recite that there be inboard coupler receiving means connected to the snowplow blade (14). The term connected is used to establish that the coupling means on the snowplow blade (100) is permanently attached or fixed in place, employing bolts or welds for such purpose. The attachment of inboard coupler receiving means (14) comprises the first of five instances in which modifications are made to the snowplow blade (100) itself for purposes of preparing the device (1) for use. The term receiving is merely meant to more clearly suggest the complementary function of this element when considered vis-a-vis the emplacing means (13) discussed supra.

Preferably, to accomplish the objectives of the receiving means (14), in the device's first embodiment, discussed immediately supra in connection with the emplacing means (13), there should be an apertured receptor (21) attached to the snowplow blade (100) disposed horizontally. Preferably, the receptor (21) would comprise at least one plate (98) protruding from its site of attachment. Each plate (98) would in turn comprise an aperture (22) oriented vertically and when more than one plate (95) is present to provide the configuration of a twin plated receptor (99), the apertures (22) should be aligned with one another for pin (18) emplacement. When two plates (98) are so disposed as part of the receptor (21), the tongue (23) conveniently fits between them in emplacement. As discussed ante, a coupling pin (18) would be employed to engage the aperture (22) and it is preferable that the pin's (18) disposition be vertical upon insertion. In this embodiment of the device (1), the shape of receptor apertures (22), as well as the coupling tongue aperture (26), should match that of the pin's shank (30). Thus, if a cross-section of the shank (30) is rounded, the apertures (22, 26) should likewise be rounded. The diameter of the pin's head (29) should be greater than those of the apertures (22, 26), which in turn, should be slightly greater than that of the pin's shank (30).

In the device's second embodiment, also discussed immediately supra in connection with emplacing means (13), there should be a slotted receptor (19) attached to the snowplow blade (100) and disposed horizontally. As mentioned supra concerning an apertured receptor (21), it is preferable to configure the receptor (21) with two plates (98) between which the tongue (23) may be conveniently sandwiched or emplaced. Each receptor slot (20) should be oriented vertically as with the apertured receptor (21), supra. A coupling pin (18) would be employed to vertically engage the slot (20) or slots (20) also in the same manner as with the apertured receptor (21) and the diameter of the pin's head (29) should similarly be greater than the width of the slot (20) which in turn, would similarly be slightly greater than the diameter of the pin's shank (30).

For reasons which become more apparent ante in connection with discussion of two-position emplacement, the slot (20) or slots (20) of any slotted receptor (19) should preferably be shaped at the outboard end thereof with a notched detent (97) to provide a seat for the coupling pin (18) in one of the positions employed in two-position emplacement, ante. For convenience in manufacture, it is preferable to notch both ends of the slot (20) in that manner so that the receptor (19) may be interchangeably mounted—that is, may be placed on the right as opposed to left side or in front of as opposed to behind the plow blade (100). In this preference, then, the shape of the slot (20) features a dumbell-like configuration.

It may readily be seen that the difference in the two embodiments discussed thus far is that an apertured receptor (21) is employed in the first embodiment and a slotted one (19) in the second of them. The reason for this difference is that the outboard coupling assembly (53) employed by the first embodiment is a pin type (54) while that (53) of the second is a two-position type (57).

As more specifically discussed ante, employment of the two-position coupling assembly (57) requires for adjustment from one position to another that certain elements at the inboard coupling site (10) be laterally movable within certain other elements thereat (10). For the same reasons, the length of the blade face slot (105) discussed ante should not be less than that of the pin receptor plate slot (20), discussed supra. Employment of a pin type outboard coupling assembly (54), however, does not permit such lateral movement.

Wherever the coupling pin (18) is employed, its shank (30) preferably should have a place—or loci—thereon of selected weakness (32), as expressed in some of the claims, such that the pin (18) will shear when subjected to an impact by the snowplow blade's (100) collision with an obstruction of force great enough to likely damage the device (1) or the blade (100). Experience teaches that the weakened shearing loci (32) on the pin's shank (30) should be at its aperture engagement site (31)—that is, the point at which the edge of the aperture (22, 26) or slot (20) is nearest in proximity with the shank (30).

As discussed immediately supra, the first and second embodiments permit the attachment site (24) for the coupling tongue attaching end (27) to be a point on the spoon's arcuate seating edge (8). Hypothetically, if in either of those embodiments the inboard coupling site (10) were instead disposed upon the snowplow blade's face (101), the coupling tongue's (23) length would displace the snow spoon's arcuate blade seating edge (8) away from the blade's face (101), foreclosing a snug fit between the two. To achieve the preferable snugness in fit, in the first and second embodiments employing a coupling tongue (23), a slot (105), disposed horizontally, must be cut through the snowplow blade (100) to permit passage of the tongue through it to the blade's posterior (102). The cutting of this slot (105) comprises the second of five instances in which the snowplow blade (100) is modified to prepare the device (1) for use but this modification is, in fact, obviated in the third and fourth embodiments discussed immediately ante. To permit passage of the coupling tongue (23), the slot (105) must be of width slightly greater than the thickness of the coupling tongue (23). By passing the tongue (23) through the slot (105), a snug lit may be achieved between the spoon's arcuate blade seating edge (8) and the snowplow blade's face (101). The slot (105) must also be disposed horizontally to engage the tongue (23).

For both first and second embodiments, upon emplacement of the spoon (4) against the blade (100), coupling of the entire inboard coupling assembly (16) is accomplished at the blade's posterior (102). However, in the first embodiment, the inboard receiving means (14) employs an apertured receptor (21), which is adequate where, because of outboard configuration of a pin coupling assembly (54), there is no requirement for lateral movement of any part of the inboard coupling means (13, 14). In the second embodiment, the inboard receiving means (14) employs a slotted receptor (19), which is required where, because of outboard configuration of a two-position coupling assembly (57), there is a requirement for lateral movement of certain elements of the inboard coupling means. With reference to the second embodiment, the requirement for such lateral movement is more specifically discussed ante. It may readily be seen, then, that the difference in inboard receiving means upon the snowplow blade (100) between the first and second embodiment comprises the type of receptor employed, i.e., whether merely apertured (21) or slotted (19), respectively.

As discussed supra, the third and fourth embodiments require the coupling tongue end's (27) attachment site (24) on the snow spoon (4) to be at a recess (28) disposed at a point within the spoon's arcuate seating edge (8). For both of those embodiments, upon emplacement of the spoon (4) against the blade (100), coupling of the entire inboard coupling assembly (17) is accomplished proximate the blade's face (101). A snug fit between the snow spoon's arcuate seating edge (8) and the snowplow blade's face (101) may thus be attained without requiring the coupling tongue (23) to pass through the snowplow blade's face (101). In the third embodiment however, as in the first embodiment discussed immediately supra, the inboard receiving means (14) employs an apertured receptor (21), which is adequate for the same reasons mentioned in connection with the first embodiment, supra, relating to the outboard pin coupling assembly (54).

It may readily be seen, then, that the difference in inboard coupler receiving means (14) upon the snowplow blade (100) between the first and second embodiments, on the one hand, and the third and fourth, on the other, is that the entirety of the inboard coupling assembly (15) is disposed at the snowplow blade's posterior (102) for the first two and upon the snowplow blade's face (101) for the last two thereof. Further, as was the case with the first and second embodiments, the difference in receiving means upon the snowplow blade (100) between the third and the fourth embodiments considered separately comprises the type of receptor employed, i.e., whether merely apertured (21) or slotted (19), respectively.

As in the case with the first two embodiments, it is preferable also in the cases of the last two embodiments and for the same reasons that the receptor (19, 21) comprises not merely one, but two plates between which the tongue (23) may be emplaced.

The second and fourth embodiments, employed with a two-position coupling assembly (57), share the configuration explained supra which requires that coupling occur in front of the snowplow blade (100). While little difficulty is incurred in the engagement of a coupling pin (18) at either of the engagement sites (11) of the first and third embodiments, in order to permit such engagement in the second and fourth embodiments, portions of the snow spoon (4) along its arcuate edge (8) must be removed in manufacture near the engagement sites (12) to permit sufficient clearance for insertion and withdrawal of the pin (18). The cutout area remaining after such removal has been made is referred to herein as a coupling clearance gap (9).

All four embodiments of the foregoing inboard coupling means (13, 14) are asserted herein as suitable but others known in the prior art may be equally useful. Some of the claims set forth the second and fourth inboard coupling embodiments discussed supra. In doing so, the features are not considered merely preferable but the substance of the claim itself.

The claims recite that the device (1) comprise a stabilizing plate (33) as part of its (1) structure. The stabilizing plate (33), comprises a snow spoon juncture edge (34); an outboard face (35); an inboard face (36); a posterior portion (37) with an abutment region (38) and in turn, an abutment flank (39) within that region (38). In keeping with the usual definition of the word, the stabilizing plate (33) lends rigidity to the structural relationship between the snow spoon (4) and the snowplow blade (100). The abutment flank (39) is emplaced against the snowplow blade end ridge (103). Preferably, the stabilizing plate (33) is attached to the snow spoon's outboard face (6) along its (33) entire vertical length. Usual attachment means, including a weld, may be employed. The stabilizing plate (33) is an indispensible part of the invention (1), required to support the snow spoon (4) at the outboard coupling site (50) regardless of the coupling mechanism (53) employed. Its (33) inclusion is essential for such support because, as discussed supra, the snow spoon's leading edge (7) is situated forward from the snowplow blade (100), not in proximity to it (100) as with the inboard coupling site (10).

Outboard coupler emplacing means (51), discussed ante, must be made to operate in conjunction with the stabilizing plate (33). If an outboard pin coupling assembly (54) is employed, there would preferably be a coupling pin (18) present and an outboard apertured coupling tongue (55) configured much the same way as the inboard coupling tongue (23). The outboard tongue aperture (56), which merely accommodates the pin (18), may be identical to that (26) of the inboard tongue (23). A slot (107) must be cut into the blade end ridge (103) to accommodate the tongue (55) but this slot (107) need not be as wide as the one cut into the face of the snowplow blade (105) because there is no requirement to allow for horizontal adjustment within it (107) as there is for the other (105). The cutting of that slot comprises the third of five instances in which modifications are made to the snowplow blade (100) itself for purposes of preparing the device (1) for use. That modification (107) would be obviated, however, if an assembly other than the pin coupling one (54) were employed.

If a two-position outboard coupling assembly (57) is employed, it would preferably comprise an abutment flank positioning nipple (41) which upon emplacement engages an abutment aperture (106) in the snowplow blade's end ridge (103). The drilling of that aperture (106) comprises the fourth of five instances in which modifications are made to the snowplow blade (100) itself for purposes of preparing the device (1) for use.

The claims recite that there be outboard coupler emplacing means connected to the snow spoon (51, 58) What was stated supra in connection with the inboard coupling means (13, 14) has equal force here, except that outboard emplacement of the snow spoon (4) must allow for the fact that the snow spoon's leading edge (7) is disposed outward from the inboard coupling site (10) and forward of the snowplow blade (100). Outboard coupler emplacement means (51) may comprise either that employing the pin (18) or that of the two-position assembly (58)

Preferably, to accomplish the objectives of the emplacing (51, 58) means, in one of its embodiments, the device (1) should have affixed to it a contraction binder (200), frequently referred to in agricultural pursuits as a load binder (200), as mentioned supra.

No claim is made herein for the contraction binder itself (200), which merely comprises a part of the two-position coupling assembly (57) for those embodiments of the invention (1) comprising that type thereof. However, some diversion is required herein to discuss the manner in which load or contraction binders (200) are employed in the prior art. They (200) are configured such that they can easily be manipulated to shorten or extend a length of cord, chair or other binding material (60) so as to tighten or loosen, respectively, the binding upon a load. Of course, a load is capable of being secured without the aid of a load binder (200). To accomplish that objective, one need do little more than secure each end of a cord, chain or other binding material (60) across the load sought to be bound in place, double some portion of the binding material (60) over upon itself and fix the doubled up portion in place by any one of several known means. A typical contraction or load binder (200), when employed for the same purpose, may be fastened to either end of the cord for attachment in place. Alternatively, it may be inserted at a more central portion of the binding material's (60) length. The latter is preferable and to symplify discussion, that type of connection is considered herein. A first length (62) of the binding material (60) is attached to the snow spoon's outboard face (6), to the stabilizing plate's outboard face (35) or to a brace (73), if present. A second length (63) of the binding material (60) is operably connected to the snowplow blade posterior (102). Each of the two lengths (62, 63) of binding material (60), therefore, has an intermediate end (69, 70, respectively). The first length's intermediate end (69) is attached to the closed end of the contraction binder's second U shaped frame (209). The second length's intermediate end (70) is configured to accommodate the snow spoon's position adjustment hook's (71) emplacement within it.

The binder itself (200) is a doubly pivoted mechanism. It comprises an operable handle (201) which has a pivoting end (202) and a non-pivoting or free end (203). The handle (201) pivots upon the open end (205) of a first U shaped frame (204). The term "pivots upon" as used herein means so situated as to permit a turning of one part upon another. Typically, such pivoting action is accomplished by disposing an axle through the end of the pivoting end of the handle (201), bridging the space between and respectively attaching to the two prongs of the first U shaped frame (204). The oppositely disposed closed end (206) of the first U shaped frame (204) is attached to the free end (69) of the first length (62) of binding material (60). That closed end (206) of the first U shaped frame (204) is itself pivoted upon the open end (208) of a second larger U shaped frame (207) within which it (206) is situated. A snow spoon adjustment hook (71) is attached to an oppositely disposed closed end (209) of the second U shaped frame (207). This hook (71) is operably connected to the free end (70) of the second length (63) of binding material (60). "Operably connected", as the words are used herein, refers to securing the adjustment hook (71) into a portion of the binding material (60). For that purpose, any one of several configurations known to the prior art might be employed. Preferably, however, the binding material (60) should comprise a chain, any one of the links (61) of which might be engaged by the adjustment hook (71). That configuration provides a plurality of sites into which adjustment, tightening or loosening, can conveniently be made.

Figure 22:
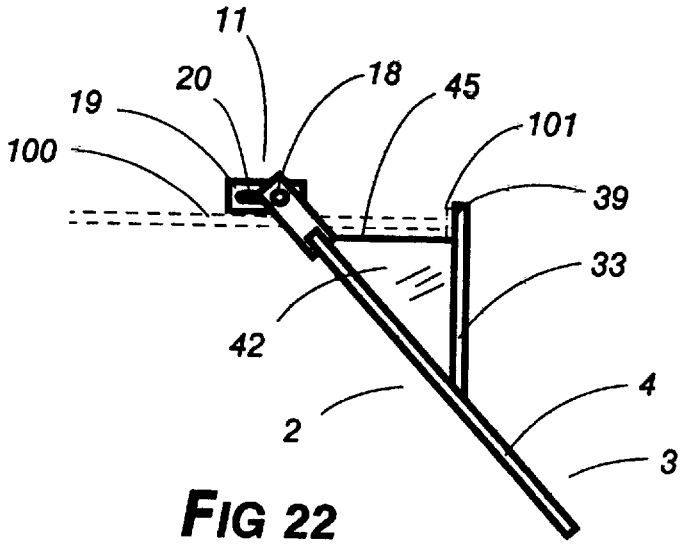
FIG. 22—top view of outboard coupling site for first of alternative positions in two-position coupling oriented along line 3—3 of FIG. 2.
Figure 23:
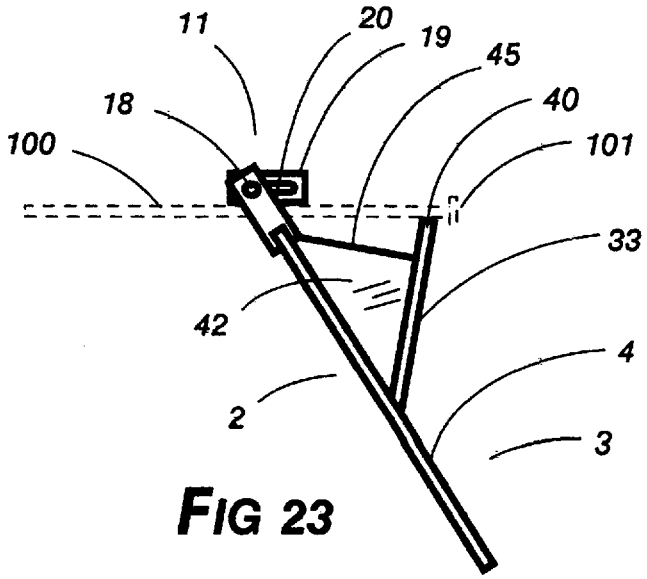
FIG. 23—top view of outboard coupling site for second of alternative positions in two-position coupling oriented along line 3—3 of FIG. 2.
Figure 24:
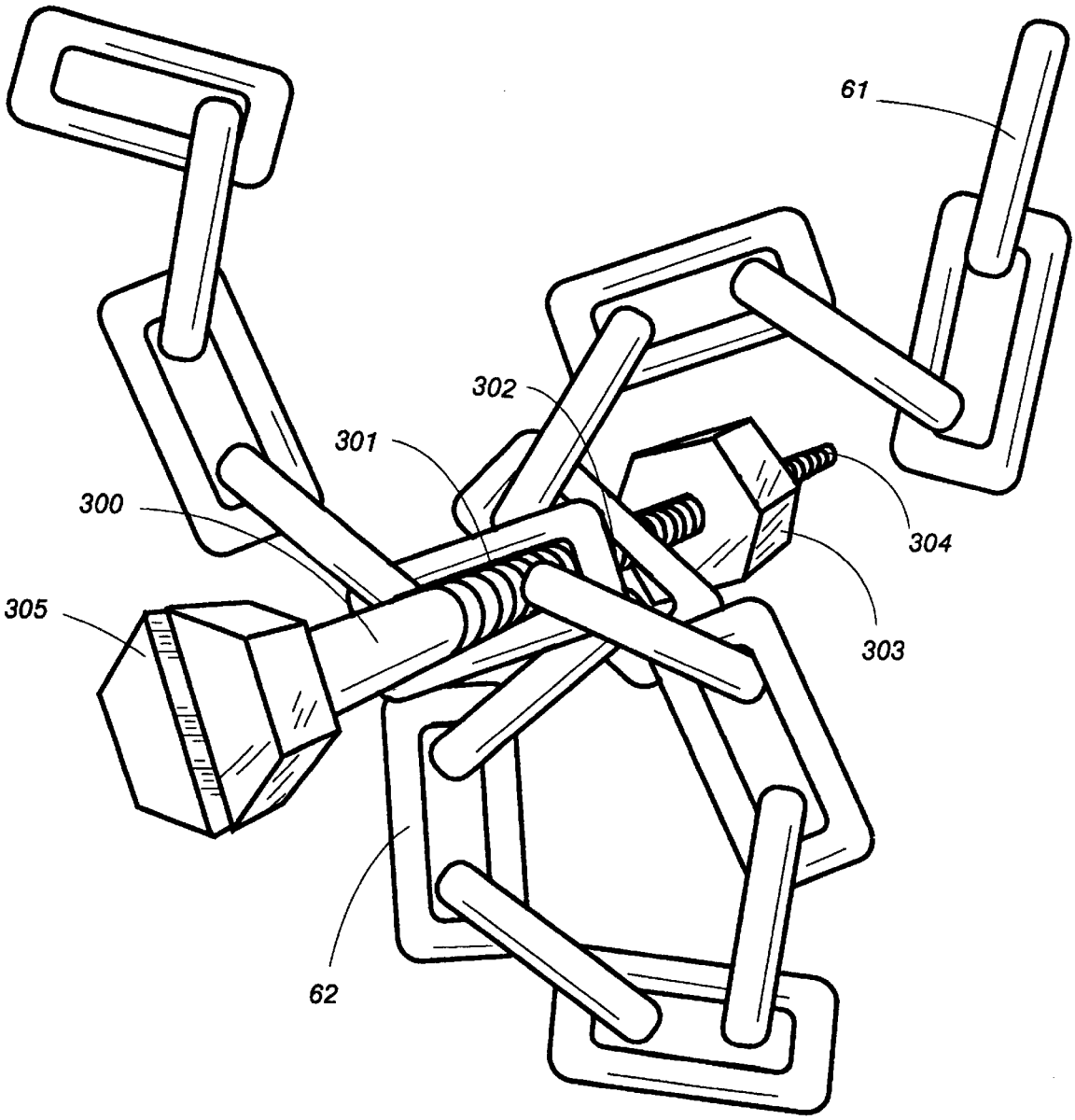
FIG. 24—perspective view of components employed in two-position fine adjustment following emplacement in either of two coupling alternatives.
Figure 25:
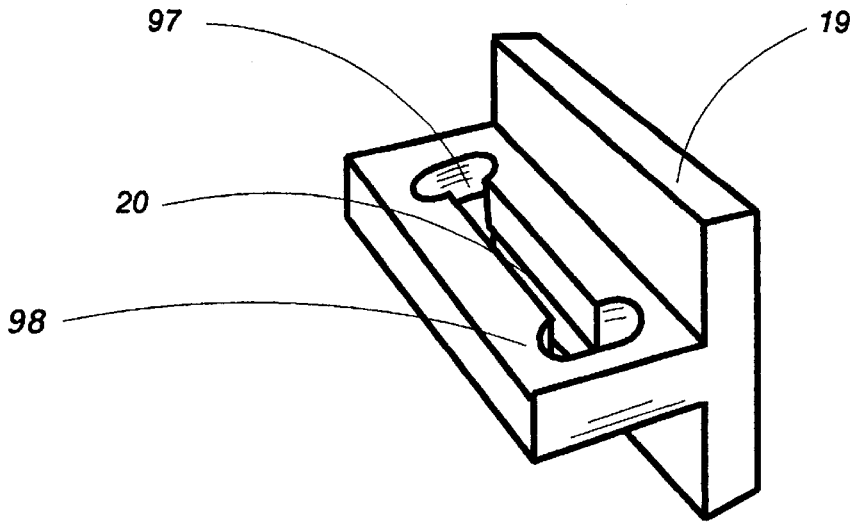
FIG. 25—plan view of receptor plate with detent notch (93)
Figure 26:
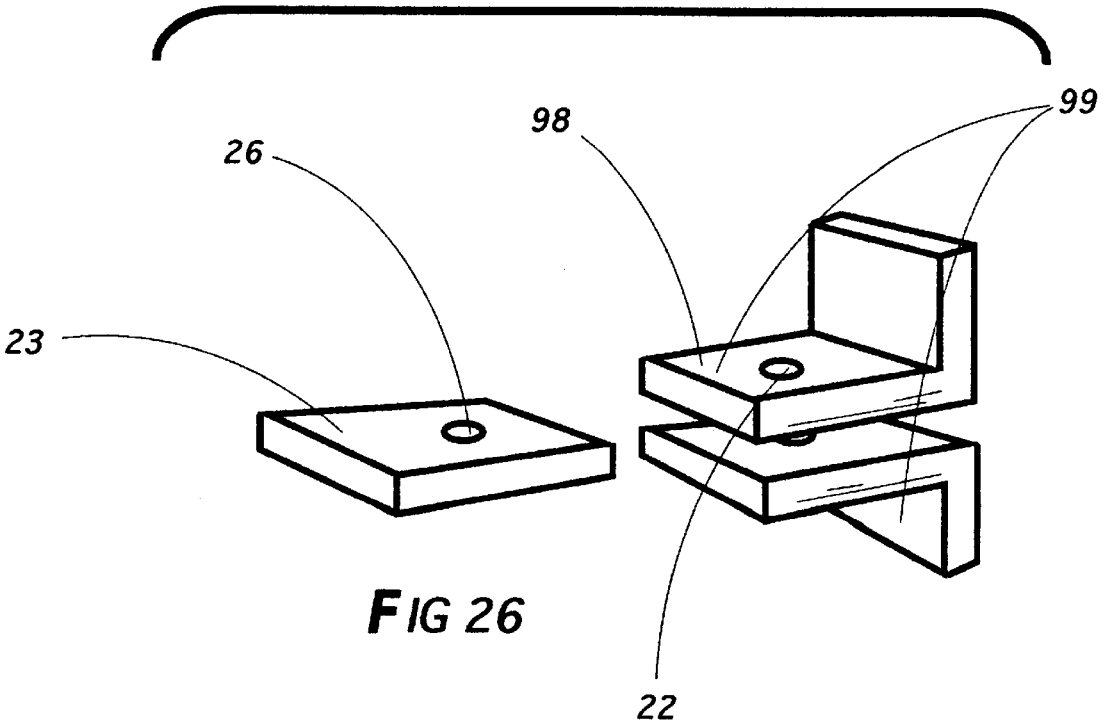
FIG. 26—side view of receptor with two plates (94).

In operation, the handle (201) is manipulated first to pivot the open end (205) of the first U shaped frame (204) away from alignment with the binding material (60) and then back into alignment with it (60) at a different place, thereby shortening or lengthening the binding material (60), respectively. Thus, the non-pivoting or free end (203) of the handle (201) is permitted to remain in the same relative position it occupied before manipulation, while the open end (205) of the first U shaped frame itself (204), upon which the handle (201) pivots, undergoes movement. Such movement is permitted because of the pivoting action of the first U shaped frame (204) upon the open end (208) of the second larger U shaped frame (207). FIGS. 22 and 23 illustrate the two positions attainable by means of the contraction binder (200).

The contraction binder handle (201) may, if desired, be held firmly in place by tying it with wire passed through holes made for that purpose in the stabilizing plate (33) or other convenient connection point.

The first length (62) of the binding material (60), the adjustment hook (71), and the load binder (200) comprise the outboard two-positioning emplacing assembly (58). The second length (63) of the binding material (60), an apertured receptor (65) attached to the snowplow blade posterior (102) and the receptor insertion hook (64) which is connected to that locus (102) comprise the outboard two-position receiving assembly (59), more specifically discussed ante.

The orientation of the emplacing assembly (58) and the receiving assembly (59) could just as well be reversed so that the hook (71) is attached to the closed end of the first U shaped frame (204) and the second larger U shaped frame (207) is attached to the intermediate end (69) of the first length (62) of binding material (60). Furthermore, the incorporation of either length of binding material (60) could just as well be obviated merely by attaching one of the ends (206, 209) of the load binder directly to the snowplow posterior or the invention's (1) respective attachment sites specified supra (6, 35, 73). Applicant does not intend to limit the parts of the two-position assembly (57) to any one particular coupling orientation and has alluded merely to one of them to simplify explanation.

As with the inboard means (13, 14) discussed supra, the claims recite in part that there be outboard coupler receiving means connected to the snowplow blade (52). Again, what was stated there in connection with the inboard receiving means (13, 14) has equal force here so long as the forward and outward disposition of the snow spoon's leading edge (7) is taken into account. However, an additional factor must be considered concerning the outboard coupler receiving means (52). The outboard coupling site (50) is disposed so as to provide first and second alternative coupling positions.

As mentioned supra, the second length (63) of the binding material (60) is operably connected to the snowplow posterior (102). That connection is made by insertion of a receptor insertion hook (64) attached to the connecting end of the binding material (60) into an apertured receptor (65) disposed at that site (102). In the first of the two alternative outboard positions of the two-position coupling assembly (57), the abutment flank (39) of the stabilizing plate (33), discussed supra, is made to contact the snowplow blade's end ridge (103) upon emplacement of the invention (1). However, in the second of the two alternative positions of that assembly (57), the stabilizing plate's arcuate posterior abutment edge (40) is emplaced in contact with the snowplow blade's face (101). It should be understood that to remove the invention (1) from the first outboard coupling position and emplace it in the alternative second one thereof, one would merely disengage the snow spoon position adjustment hook (71) from a chain link (61) in which it had been inserted; withdraw the stabilizing plate's abutment flank (39) from the snowplow end ridge (103), shift the snow spoon (4) as much farther inboard as the length of the inboard pin receptor plate slot (20) and, if one is indeed present, the slot (105) cut in the inboard snowplow blade face (101) will allow; reposition the stabilizing plate's arcuate posterior abutment edge (40) against the snowplow blade's face (101); and insert the snow spoon position adjustment hook (71) into a portion of the binding material, preferably into a chain link (61), selected to provide a snug fit of the snow spoon (4) to the snowplow blade (100).

When emplacing in the second of the two-position alternative, some repositioning at the inboard site (10) occurs also. At that site (10), the slot (105) in the snowplow blade (100) provides means by which the snow spoon's inboard portion (2) may be laterally repositioned much in the manner a sliding patio door is moved along a track.

Snugness in fit at the outboard site (50) and suitable binding material (60) support in the first alternative adjustment position is enhanced by allowing the first length of binding material (62) to be strung through and supported by a notch (47) cut in the stabilizing plate's posterior portion (37).

Experience shows that arrangements incorporating a contraction binder (200) for the purpose of coupling one inelastic, non-compressible object with another, however, do not quite provide the snugness in fit sufficient to accomplish the objectives of the invention (1). Simple tightening means known in the prior art may be employed for that purpose. An elongated fine adjustment bolt (300) may be inserted at a first point (301) along the length of binding material (60) employed with the contraction binder (200) and extended to be further inserted at a second point thereon (302). An adjustment nut (303) may be threaded upon an end thereof (304). Conventional hand tools such as a screwdriver or wrench may be employed to turn the bolt's head (305) to secure the nut (303) on the threaded end (304). The effect of inserting the bolt (300) in this manner is to double up the length of binding material (60) between the two points (301, 302), thereby shortening it. This provides a means of fine adjustment, as distinguished from the more coarse adjustment accomplished by the contraction binder (200). If the binding material (60) comprises a chain, which is preferable, the links thereof (61) conveniently comprise the insertion points (301, 302) for the bolt (300).

The same shearing capabilities are provided at the outboard site where the two-position mode is employed as are provided at the inboard site. There are numerous ways to incorporate a coupling pin (18) connection into some point of the two position assembly. One way to provide a connection point is to provide a fork shaped connector into the two tines of which an extension is position, both having an aligned aperture through which a pin (18) may be emplaced. Because of the widespread familiarity with pin connections already extant in the prior art, it is unnecessary that any particular configuration be insisted upon for that purpose. It is only important for this purpose that a pin (18) have an emplacement site within the outboard two-position coupling assembly (57) so that it's shank, configured with shearing loci (32), will break upon impact to the system as discussed supra. The provision of shearing capability at the outboard coupling site (50) protects the system when an object on the roadway is struck in the same way inboard coupling site (10) shearing capability offers such protection when the impact is incurred in forward snowplow movement.

Prior art outboard coupling is of the coupling pin (18) type. Whether the pin (18) is oriented vertically or horizontally, precautions to provide shearing capability at the prior art outboard site (50) is of little use when impacts are encounted upon backing because of the stress imparted at the rigidly attached inboard site (10). The inboard site (10) pivoting capability of applicant's invention, permitted by the slotted pin receptor (19) in that embodiment, causes the stabilizing plate (33) to swing inboard along a circular path allowing it (33) to clear the snowplow blade end ridge (103).

As with the inboard coupling means (13, 14), supra, this outboard two-position coupling assembly (57, 58, 59) is asserted herein as a preferable one. Other two-position techniques may also be possible. In the claims, applicant sets forth this coupling assembly (57, 58, 59) not as merely preferable but, just as in the case with inboard coupling means (13, 14), as the substance of the claim itself.

The two-position alternative feature at the outboard coupling site (50), thus, employs both the outboard emplacement assembly (58) and the outboard receiving assembly (59) together as emplacement means (51) and receiving means (52), respectively. Either of the two adjustment positions may be operably selected—that is, may be selected from at the job site. There is a reduction of frontal profile in the second of the two positions because of partial inboard retraction of the snow spoons (4) when adjusted to that position.

Two two-position outboard coupling feature should not be confused with the two alternative inboard coupling alternatives discussed supra. The choice between configurations involving attachment of the inboard receiving means (14) upon the snowplow blade's posterior (102) and attachment thereof upon the snowplow's face (101) is one made in manufacture or in retrofitting an already existing snowplow blade (100) to accommodate the device (1). The configuration involving attachment of receiving means on the blade's posterior (102) also requires that the manufacturer or retrofitter cut the slot (105) in the snowplow blade (100). This selection of alternatives is permanent in that once one of the two inboard coupling alternatives upon a given snowplow blade (100) is selected by the manufacturer or retrofitter, the other coupling alternative is foreclosed.

Some embodiments of the invention (1) include a brace (73), a first end of which (74) attaches to the snow spoon's outboard face (6) and a second end of which (75) attaches to the stabilizing plate's posterior portion (37). Because the stabilizing plate's abutment region (38) is emplaced against the snowplow blade's end ridge (103) and the snow spoon (4) is oriented at the angle discussed supra, a brace (73) attached to the outboard faces (6, 35) of those two structures (4, 33) must necessarily extend across an angle which is very wide in aspect.

The brace (73), when included as part of the structure, is merely one of several means which may be employed to increase structural integrity and is not absolutely essential for the device's (1) satisfactory operation. The stabilizing plate (33) itself, provides substantial bracing.

Gussets (42) attached within the acute angle between the snow spoon (4) and the stabilizing plate (33) may be included to provide additional support. These (42) are pie-shaped plates comprising an inboard edge (43), an outboard edge (44), a posterior edge (45) and a vertex (46). Gusset (42) bracing results from a wedging attachment of its inboard edge (43) to the snow spoon's outboard face (6) and its outboard edge (44) to the stabilizing plate (33). In the first adjustment position of two-position outboard coupler emplacing means (51), the gusset's posterior edge (45) is disposed to fit snugly against the snowplow blade's face (101) to provide additional bracing support. In the second of the two outboard adjustment positions, however, that edge (45) is displaced forward from any part of the snowplow blade (100). These two adjustment positions are shown in FIGS. 22 and 23, respectively.

The inboard coupling site (10) also cooperates in bracing support. The brace (73) may be conveniently employed in additional functions, however, when used in conjunction with an obstruction buffer (76), a whip sight assembly (81) or an alternative contraction binder (66) attachment site.

Some embodiments of the invention also provide for an obstruction buffer (76) attached to its outboard side (3) to meet the needs discussed supra. It (76) may feature simple fending plates (77) or a more elaborate wheel assembly (78). In operating the snowplow near a curb, the operator's use of a buffer (76) is facilitated by the fact that its contact with the curb causes gentle vibration. If the level of this vibration is sufficient, it may be felt by the operator and help assure cleaning as close to the curb as possible. In embodiments employing a wheel assembly (78), vibration is minimized due to the near frictionless rolling of the wheel (79) against the curb. The wheel (79), if present, is disposed upon an uprightly oriented axle (80). While operation with such wheels (79) provides advantages in some situations, a polygonal wheel shape, an octagonal one for example, provides a more acceptable level of vibration if that is desired by a given operator.

In snowplowing operation, the obstruction buffer (76) may be temporarily withdrawn from use by turning the plow blade (100) backwards along the curb at an angle. When it is desired to employ it (76) in use, the blade (100) would be returned to its former position.

In manufacturing, it is preferable to configure the fending plate (77) of the obstruction buffer (76), as well as several other parts with openings or cutouts which facilitate the welding together of its parts, reduce the buffer's (76) weight and provide a path for waste snow which might otherwise build up upon the system.

Some embodiments of the device (1) provide for a whip sight assembly (81), which includes a flexible whip sight mast (82). The mast (82) is held in place by a whip anchor (95) and is sufficiently flexible to permit its end to be bent downward to engage a stowage receptor (83) when the snowplow is not in use. When the mast (82) is forced backward upon subjection to frontal impact with snow drifts or any obstacles in the path of travel, it is bent backward. Such bending stretches a whip spring (94) secured at a spring anchor (96). The spring (94) afterwards contracts to force the mast (82) forward until it strikes a whip stop (93), restraining it (82) to its original upright position.

The snowplow blade's posterior (102) may be further modified to receive the device (1) in stowage and meet the needs discussed supra concerning reduction of the system's frontal profile. Usually, there are large areas at the blade's posterior (102) which permit such stowage. Modification for stowage purposes, if made, comprises the fifth of five instances in which the snowplow blade (100) is modified to prepare the device (1) for use. For purposes of stowage, the device (1) may have stowage emplacement means (84) specially formed upon it. However, any suitably shaped part of the device (1), such as a stabilizing plate (33), or brace (73) should one be present as part of the structure, may be hung on snowplow blade posterior stowage receiving means (85) for it (1). Such receiving means (85) may take the simple shape of a hook.

When the snowplow is operated upon the roadway but not in snowplowing operation, provisional stowage means may be employed. A snowspoon (4) may be disconnected at the outboard site so that (4) may be pivoted inwards to minimize frontal profile. Snowplowing operation in the second of the two-position mode may sufficiently reduce frontal profile such that the exercise of other stowage means is unnecessary.

Some embodiments reduce frontal profile of a snowplowing system as it travels along a highway with the invention (1) in place. This may be accomplished by a configuration permitting inward folding of part or all of the snow spoon. The snow spoon may be divided vertically into two parts. The more posterior of the two parts (86) remains in place. The more anterior thereof (87) is the folding part. A vertical hinge (88) connects the two parts and comprises a folding fulcrum (89) for folding. So that the snow spoon retains rigidity while in operating position, however, latching means (90) for the two sections (86, 87) is attached to the outboard face of the snow spoon. The latching means (90) is comprised of a latch (91) and a latch receptor (92). There are numerous types of latch mechanisms in the prior art. Preferably, the latch (91) comprises a rigid bolt which may be slid along a sleeve to engage the latch receptor (92). Various known means may be employed to assure that the latch (91) remains in that position during operation but readily detaches therefrom for nonoperational stowage during travel. As mentioned, supra, the invention (1) would generally be utilized to clear parking lots, driveways and other related urban snowplowing tasks. However, it (1) would also be of considerable benefit in snowplowing a highway. If so used, upon completion of a snowplowing task, the two parts (86,87) of the left snow spoon might be unlatched and the second part (87) folded inward upon the hinge (88) for the return home trip. The snowplow might then be operated in the same manner as any other vehicle on the highway without the operator's concern that a portion of the system might be projecting across the centerline.

The inventor hereby claims:

1. A snowplow snow channeler for use in conjunction with a snowplow blade, the snow channeler comprising:

a pair of enantiomeric snow spoons, each comprising:

an inboard snow spooning face;

an outboard face;

a leading edge;

an arcuate snowplow blade seating edge;

inboard coupler emplacing means connected to the snow spoon;

inboard coupler receiving means connected to the snowplow blade;

outboard coupler emplacing means connected to the snow spoon; and outboard coupler receiving means connected to the snowplow blade comprising first and second alternative coupler sites;

the snow channeler further comprising:

a stabilizing plate comprising in turn:

an anterior snow spoon juncture edge;

an outboard face;

an inboard face comprising in turn:

a snowplow end ridge abutment flank disposed along the posterior region thereof whereby the stabilizing plate may be emplaced against the snowplow end ridge; and an arcuate posterior abutment edge mated to the face of the snowplow blade;

the snow channeler further comprising:

a brace comprising in turn a first end connected to the outboard face of the snow spoon and a second end connected to the outboard face of the stabilizing plate;

whereby the snow channeler's structural integrity is enhanced and may be emplaced upon the snowplow blade and selectively disposed in first and second alternative coupled positions.

2. The snow channeler described in claim 1, further comprising an obstruction buffer connected to the outboard side thereof, whereby the snow channeler and snowplow blade may be protected from contact with outlying roadside obstructions.

3. The snow channeler described in claim 1, further comprising snow channeler stowage emplacing means connected to the snow channeler and snow channeler stowage receiving means connected to the snowplow blade's posterior.

4. The snow channeler described in claim 1, further comprising:

vertical division of each snow spoon thereof into a first part and a second folding part, wherein the second part is anterior to the first part; and at least one hinge connected to the two parts and disposed such that the first part, the anterior second part and the hinge means comprise a folding fulcrum wherein the second part may be pivoted thereabout against the first part;

the folding fulcrum being situate at any fixed selected point on the snow spoon including the inboard coupling site;

whereby one or both snow spoons, when not employed in snowplowing, may be folded together for highway safety improvement by reducing frontal profile of the snowplow blade and snow spoon combination;

the first and second parts of the snow spoon further comprising at least one set of latching means, wherein the first latch part is disposed on the first snow spoon part so as to operably engage the second latch part; and the second latch part is disposed on the second snow spoon part so as to operably engage the first latch part;

whereby the first and second snow spoon parts may be latched together to provide structural rigidity during snow spoon employment in snowplowing.

5. A snowplow snow channeler comprising:

a pair of enantiomeric snow spoons, each comprising:

an inboard snow spooning face;

an outboard face;
a leading edge;
an arcuate snowplow blade seating edge;
inboard coupler emplacing means connected to the snow spoon;
inboard coupler receiving means connected to the snowplow blade;
outboard coupler emplacing means connected to the snow spoon; and
outboard coupler receiving means connected to the snowplow blade comprising first and second alternative coupler sites;

the snow channeler further comprising:

an obstruction buffer connected to the outboard side thereof, comprising a wheel assembly comprising in turn at least one wheel;

whereby the snow channeler may be emplaced upon the snowplow blade, selectively disposed in first and second alternative coupled positions and be protected from contact with outlying roadside obstructions.

6. The snow channeler described in claim 5, further comprising an obstruction buffer connected to the outboard side thereof, whereby the snow channeler and snowplow blade may be protected from contact with outlying roadside obstructions.

7. The snow channeler described in claim 5, further comprising snow channeler stowage emplacing means connected to the snow channeler and snow channeler stowage receiving means connected to the snowplow blade's posterior.

8. The snow channeler described in claim 5, further comprising:

vertical division of each snow spoon thereof into a first part and a second folding part, wherein the second part is anterior to the first part; and at least one hinge connected to the two parts and disposed such that the first part, the anterior second part and the hinge means comprise a folding fulcrum wherein the second part may be pivoted thereabout against the first part;

the folding fulcrum being situate at any fixed selected point on the snow spoon including the inboard coupling site;

whereby one or both snow spoons, when not employed in snowplowing, may be folded together for highway safety improvement by reducing frontal profile of the snowplow blade and snow spoon combination;

the first and second parts of the snow spoon further comprising at least one set of latching means, wherein
the first latch part is disposed on the first snow spoon part so as to operably engage the second latch part; and
the second latch part is disposed on the second snow spoon part so as to operably engage the first latch part;

whereby the first and second snow spoon parts may be latched together to provide structural rigidity during snow spoon employment in snowplowing.

9. A snowplow snow channeler for use in conjunction with a snowplow blade, the snow channeler comprising:

a pair of enantiomeric snow spoons, each comprising:
an inboard snow displacing face;
an outboard face;
a leading edge;
an arcuate snowplow blade seating edge;
an inboard coupling site;
an inboard coupling assembly disposed at the inboard coupling site and comprising:
a coupling pin;
at least one slotted pin receptor plate connected to the snowplow blade; and
a coupling tongue connected to a tongue attachment site disposed along the blade seating edge and comprising:
an apertured snowplow blade coupling end; and
an opposing snow spoon attachment end; the tongue attachment site comprising one of:

a point along the arcuate seating edge, whereby the coupling tongue may be extended though a slot in the snowplow blade and engage the coupling pin and slotted receptor at the blade's posterior;

a point within an attaching recess along a portion of the arcuate seating edge, whereby the coupling tongue may engage a coupling pin and slotted receptor disposed at the snowplow blade's face;

the coupling pin comprising:
a head of diameter greater than that of the aperture of the coupling tongue and the slot of the snowplow blade receptor plate; and
a shank of diameter along its entire length lesser than that of the tongue and the receptor apertures; and
a receptor aperture engagement site disposed upon the pin shank;

whereby the snow spoon may be operationally coupled to and uncoupled from the snowplow blade at its inboard situs;

the aperture engagement site of the coupling pin comprising a locus of selected weakness;

whereby a shearing thereof may occur upon subjection to a selected level of impact;

the snowplow snow channeler further comprising:
a stabilizing plate comprising in turn:
an anterior snow spoon juncture edge;
an outboard face;
an inboard face comprising in turn:
a snowplow end ridge abutment flank disposed along the posterior region thereof whereby the stabilizing plate may be emplaced against the snowplow end ridge; and
an arcuate posterior abutment edge mated to the face of the snowplow blade;

the snowplow channeler further comprising:

at least one gusset disposed between the snow spoon and the stabilizing plate comprising:
an outboard disposed edge connected to the stabilizing plate's inboard face;
an inboard disposed edge connected to the snow spoon's outboard face;
a posterior edge; and
a vertex disposed at a juncture between the stabilizing plate and the snow spoon proximate the stabilizing plate's anterior snow spoon juncture edge;

the snowplow channeler further comprising:
an outboard coupling site; and
an outboard receiving assembly comprising:
a chain comprising:
a first length;
a second length; and
a plurality of links;
the first length of the chain extending through a notch disposed in the stabilizing plate's abutment region, the notch supporting a portion of the chain along its length;

the outboard emplacing assembly further comprising:

a receptor insertion hook connected to an end of the first length of the chain;

an apertured hook receptor connected to the snowplow blade's posterior, wherein the hook may be inserted;

a contraction binder, comprising in turn:

an operable handle;

a first end attached to the second length of chain attached in turn to one of:

the outboard face of the snow spoon;

the outboard face of the stabilizing plate; and a brace attached in turn to the outboard face of the snow spoon and the outboard face of the stabilizing plate;

the contraction binder further comprising:

a second end;

a snow spoon position adjustment hook attached to the second end and operably inserted in a selected link in the first length of chain;

whereby, the snow channeler may be operationally coupled to and uncoupled from the snowplow blade at its outboard coupling situs so as to permit emplacement thereof, removal thereof or adjustment thereof to and from either of first and second alternative coupling positions:

a first coupling position by emplacing the stabilizing plate's snowplow end ridge abutment flank against the snowplow blade end ridge and securing it thereat by inserting the snow spoon position adjustment hook into a first selected link in the first length of the chain; and a second coupling position by emplacing the stabilizing plate's arcuate posterior abutment edge in flush contact with the snowplow blade face and securing it thereat by inserting the snow spoon position adjustment hook in a second selected link in the first length of the chain;

whereby either of two alternate angular dispositions of the snow spoons may be operably selected to accommodate varied plowing objectives.

10. The snow channeler described in claim 9, comprising a brace comprising in turn a first end connected to the outboard face of the snow spoon and a second end connected to the outboard face of the stabilizing plate;

whereby the snow channeler's structural integrity is enhanced.

11. The snow channeler described in claim 9, further comprising an obstruction buffer connected to the outboard side thereof, whereby the snow channeler and snowplow blade may be protected from contact with outlying roadside obstructions.

12. The snow channeler described in claim 11, comprising:

vertical division of each snow spoon thereof into a first part and a second folding part, wherein the second part is anterior to the first part; and at least one hinge connected to the two parts and disposed such that the first part, the anterior second part and the hinge means comprise a folding fulcrum wherein the second part may be pivoted thereabout against the first part;

the folding fulcrum being situate at any fixed selected point on the snow spoon including the inboard coupling site;

partial separation of the obstruction buffer from the snow channeler such that the obstruction buffer is connected to the second folding part of the snow spoon but separated from the first snow spoon part;

whereby one or both snow spoons, when not employed in snowplowing, may be folded together, retracting also the respective connected obstruction buffer, for highway safety improvement by reducing frontal profile of the combination of the snowplow blade, snow spoons and obstruction buffers;

the first and second parts of the snow spoon further comprising at least one set of latching means, wherein a first latch part is disposed on the first snow spoon part so as to operably engage the second latch part; and a second latch part is disposed on the second snow spoon part so as to operably engage the first latch part;

whereby the first and second snow spoon parts may be latched together to provide structural rigidity during snow spoon employment in snowplowing.

13. The snow channeler described in claim 9, comprising a whip sight assembly, whereby the snowplow operator may deduce the loci of the snow spoons and snow plow blade ends despite obstructions to direct observation of them;

the whip sight comprising:

a whip sight mast; and a whip sight stowage receptor, wherein the whip sight mast may be operably secured when not employed.

14. The snow channeler described in claim 9, comprising snow channeler stowage emplacing means attached to the snow channeler and snow channeler stowage receiving means connected to the snowplow blade's posterior.

15. The snow channeler described in claim 9, comprising:

vertical division of each snow spoon thereof into a first part and a second folding part, wherein the second part is anterior to the first part; and at least one hinge connected to the two parts and disposed such that the first part, the anterior second part and the hinge means comprise a folding fulcrum wherein the second part may be pivoted thereabout against the first part;

the folding fulcrum being situate at any fixed selected point on the snow spoon including the inboard coupling site;

whereby one or both snow spoons, when not employed in snowplowing, may be folded together for highway safety improvement by reducing frontal profile of the snowplow blade and snow spoon combination;

the first and second parts of the snow spoon further comprising at least one set of latching means, wherein a first latch part is disposed on the first snow spoon part so as to operably engage the second latch part; and a second latch part is disposed on the second snow spoon part so as to operably engage the first latch part;

whereby the first and second snow spoon parts may be latched together to provide structural rigidity during snow spoon employment in snowplowing.

* * * * *